US010061264B2

(12) United States Patent
Eto et al.

(10) Patent No.: US 10,061,264 B2
(45) Date of Patent: Aug. 28, 2018

(54) IMAGE FORMING APPARATUS THAT IS TRANSPORTABLE WITH DEVELOPER HOUSING CONTAINER INSTALLED ON APPARATUS MAIN BODY

(71) Applicant: KYOCERA Document Solutions Inc., Osaka (JP)

(72) Inventors: Daisuke Eto, Osaka (JP); Hidehiko Kojo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/642,009

(22) Filed: Jul. 5, 2017

(65) Prior Publication Data

US 2018/0046132 A1 Feb. 15, 2018

(30) Foreign Application Priority Data

Aug. 10, 2016 (JP) ..... 2016-157430

(51) Int. Cl.
*G03G 15/00* (2006.01)
*G03G 15/08* (2006.01)
*G03G 21/16* (2006.01)

(52) U.S. Cl.
CPC ..... *G03G 21/1652* (2013.01); *G03G 21/1676* (2013.01)

(58) Field of Classification Search
CPC ..... G03G 21/1652; G03G 21/1676
USPC ..... 399/90, 12, 13, 119
See application file for complete search history.

(56) References Cited

U.S. PATENT DOCUMENTS

2008/0212993 A1* 9/2008 Ishii ..... G03G 15/55 399/111
2010/0316414 A1* 12/2010 Saito ..... G03G 15/0872 399/258
2012/0039622 A1* 2/2012 Cho ..... G03G 21/1885 399/90
2013/0322925 A1 12/2013 Fujii ..... 399/258

FOREIGN PATENT DOCUMENTS

JP 2013-250428 A 12/2013

* cited by examiner

*Primary Examiner* — Susan Lee
(74) *Attorney, Agent, or Firm* — Stein IP, LLC

(57) ABSTRACT

An image forming apparatus includes an apparatus main body, a connector portion, and a developer housing container. The connector portion is located on the apparatus main body and includes a first input/output terminal. The developer housing container is removably mounted to the developing device. The developer housing container includes container body that houses a developer to be replenished to the developing device and a storage unit mounted to an outer surface of the container body. The storage unit includes a second input/output terminal for electrical connection to the first input/output terminal. In a state where the developer housing container is mounted to the developing device, the developer housing container has a posture changeable between: a first posture where the second input/output terminal is separated from the first input/output terminal, and a second posture where the second input/output terminal contacts the first input/output terminal to be electrically connected.

3 Claims, 32 Drawing Sheets

IMAGE FORMING APPARATUS THAT IS TRANSPORTABLE WITH DEVELOPER HOUSING CONTAINER INSTALLED ON APPARATUS MAIN BODY

INCORPORATION BY REFERENCE

This application is based upon, and claims the benefit of priority from, corresponding Japanese Patent Application No. 2016-157430 filed in the Japan Patent Office on Aug. 10, 2016, the entire contents of which are incorporated herein by reference.

BACKGROUND

Unless otherwise indicated herein, the description in this section is not prior art to the claims in this application and is not admitted to be prior art by inclusion in this section.

In a typical electrophotographic-method image forming apparatus, a developing device supplies a developer onto an electrostatic latent image formed on a circumference surface of a photoreceptor drum as an image carrier to perform a development process. The developer used for the development process is replenished to the developing device from a developer housing container.

There has been proposed a technique where the developer housing container is installed removably attachable on an apparatus main body of the image forming apparatus. In this technique, when a cover of the apparatus main body is opened, the developer housing container is mounted on the apparatus main body. Then, when a developer discharge port of the developer housing container communicates with a developer replenishment port of the developing device, the developer comes to be replenishable to the developing device.

There has been known a technique where the developer housing container includes a storage unit having an IC chip for transmitting and receiving predetermined information with the apparatus main body. As a communication method where the storage unit transmits and receives information with the apparatus main body, there has been a wireless or a contact communication method. The contact communication method has a simple configuration compared with the wireless communication method, and has an advantage in cost. When the contact communication method is employed, in a state where the developer housing container is mounted on the apparatus main body, terminals of the storage unit contacts terminals of a connector located on the apparatus main body so as to be electrically connected.

SUMMARY

An image forming apparatus according to one aspect of the disclosure includes an apparatus main body, a connector portion, and a developer housing container. The apparatus main body includes an image carrier and a developing device. The image carrier has a circumference surface that carries a developer image. The developing device supplies a developer onto the circumference surface of the image carrier. The connector portion is located on the apparatus main body. The connector portion includes a first input/output terminal. The developer housing container is removably mounted to the developing device. The developer housing container includes container body that houses the developer to be replenished to the developing device and a storage unit mounted to an outer surface of the container body. The storage unit includes a second input/output terminal for electrical connection to the first input/output terminal. The storage unit stores predetermined information. In a state where the developer housing container is mounted to the developing device, the developer housing container has a posture changeable between: a first posture where the second input/output terminal is separated from the first input/output terminal, and a second posture where the second input/output terminal contacts the first input/output terminal to be electrically connected.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
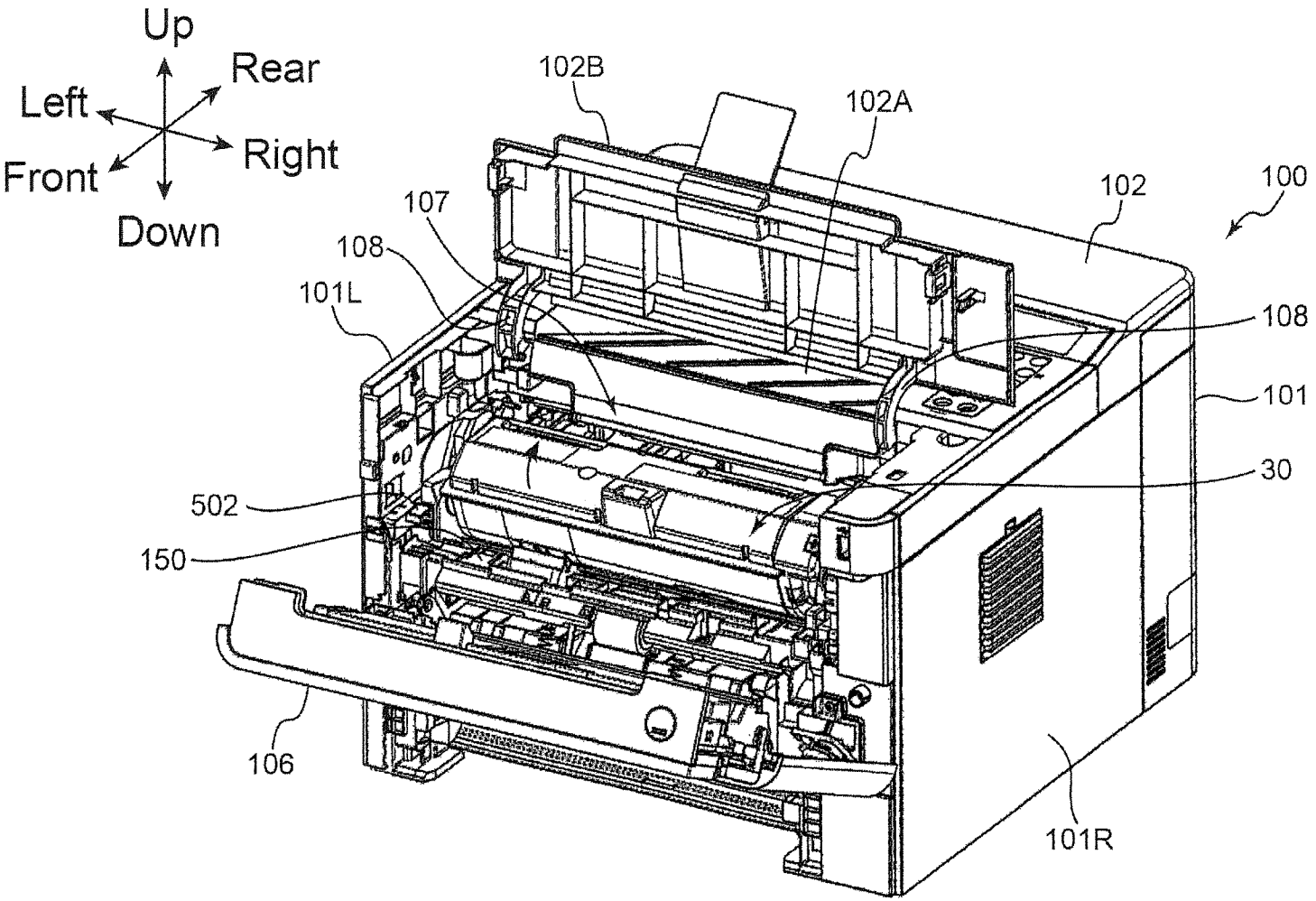
FIG. 1 illustrates a perspective view of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
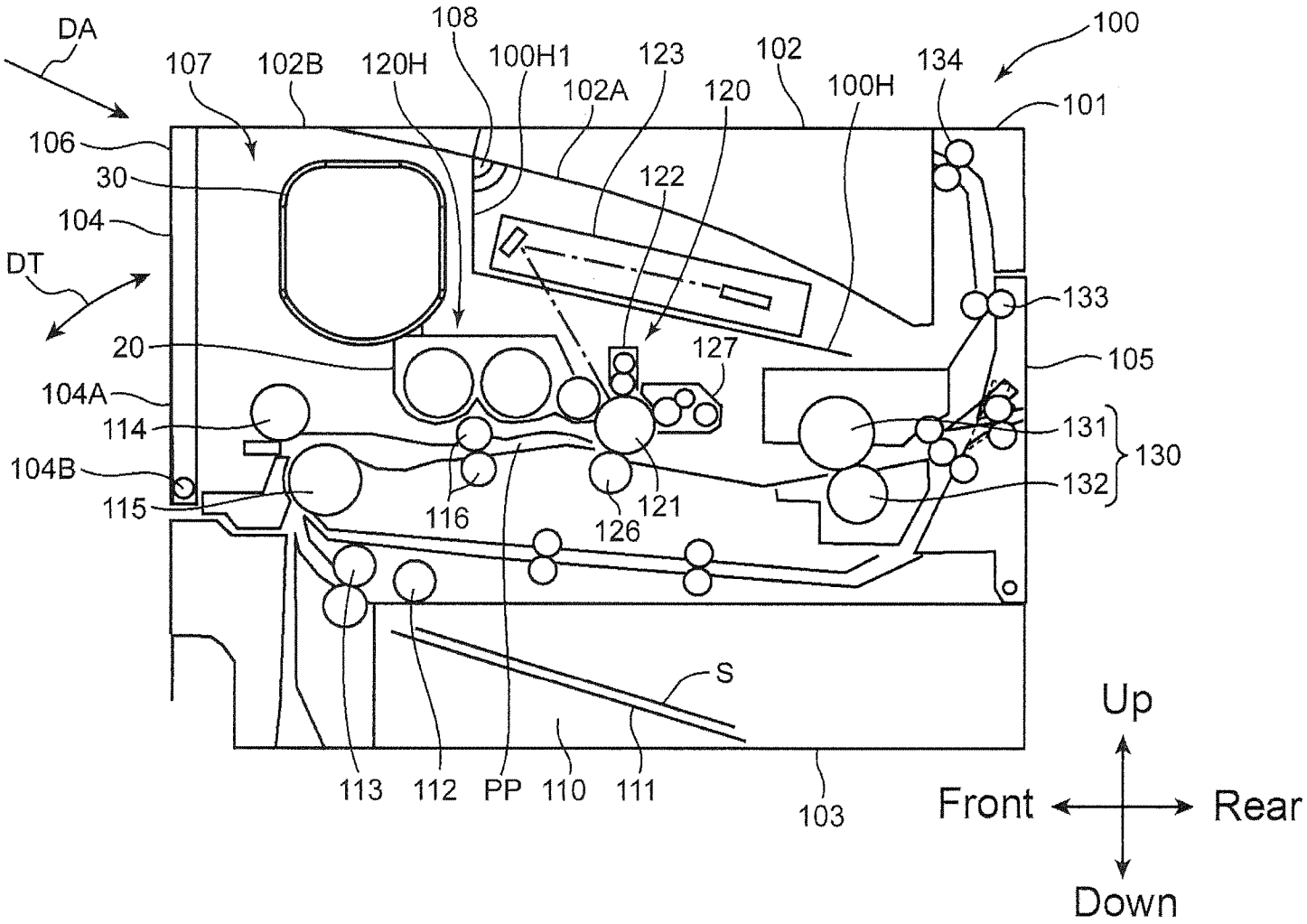
FIG. 2 illustrates a cross-sectional view of an internal structure of the image forming apparatus.

The following describes an image forming apparatus according to one embodiment of the disclosure based on the drawings. FIG. 1 illustrates a perspective view of an image forming apparatus 100 according to the one embodiment of the disclosure. FIG. 2 illustrates a cross-sectional view of an internal structure of the image forming apparatus 100. The image forming apparatus 100 is an apparatus that performs image formation processes in an electrophotographic method. In an example illustrated in FIGS. 1 and 2, the image forming apparatus 100 is a monochrome printer that performs the image formation processes based on image data output from an external device such as a personal computer. However, the image forming apparatus 100 is not limited to the monochrome printer, and may be a color printer or a copier. The image forming apparatus 100 may be a facsimile that outputs an image based on image information transmitted via a communication line.

Terms representing directions such as "up" and "down," "front" and "rear," and "left" and "right" used in the following description are simply aimed to make explanations clear, and do not limit the principle of the image forming apparatus 100. In the following description, a term of "sheet" includes a copy paper, a coated paper, an OHP sheet, a cardboard, a postcard, a tracing paper and other sheet members on which an image formation process is performed, or sheet members to which any process other than the image formation process is performed.

The image forming apparatus 100 includes a housing 101 (apparatus main body) that houses various devices to form images on a sheet S. The housing 101 includes an upper wall 102 defining a top surface of the housing 101, a bottom wall 103 defining a bottom surface of the housing 101, a main-body rear wall 105 between the upper wall 102 and the bottom wall 103, and a main-body front wall 104 located in front of the main-body rear wall 105. The housing 101 includes a main-body internal space 107 where various kinds of devices are located. In the main-body internal space 107 of the housing 101, a sheet conveyance path PP that conveys the sheet S in a predetermined conveyance direction runs. The housing 101 further includes a left-side wall 101L and a right-side wall 101R. The left-side wall 101L and the right-side wall 101R form the left and right side surfaces of the housing 101.

In the center of the upper wall 102, a paper sheet discharge unit 102A is located. The paper sheet discharge unit 102A has an inclined surface inclining downward from the front portion toward the rear portion of the upper wall 102. The sheet S with images formed in an image forming unit 120, which will be described later, is discharged into the paper sheet discharge unit 102A. In the main-body front wall 104, a front cover 106 (a cover member) and a manual bypass tray 104A are located. The front cover 106 and the manual bypass tray 104A are vertically openable/closable using respective lower end sides as fulcrums (an arrow DT in FIG. 2). The manual bypass tray 104A is turnable with respect to the front cover 106. The manual bypass tray 104A includes a tray fulcrum 104B, which serves as the fulcrum. FIG. 1 illustrates a state where the front cover 106 including the manual bypass tray 104A is open to the housing 101. With a closed state with respect to the housing 101, the front cover 106 and the manual bypass tray 104A constitute a part of the main-body front wall 104.

On the other hand, a front end portion 102B of the upper wall 102 is turnable rearward with an arm 108 as a fulcrum (see FIG. 1). As illustrated in FIG. 1, when the front end portion 102B of the upper wall 102 and the front cover 106 are each opened, the main-body internal space 107 is exposed outside the image forming apparatus 100. This results in that a developer unit 120H and a toner container 30, which will be described later, are attachable inside the housing 101. When the sheet S gets stuck in the sheet conveyance path PP, the sheet S will become removable.

Referring to FIG. 2, the image forming apparatus 100 includes a cassette 110, a pickup roller 112, a first feed roller 113, a second feed roller 114, a conveyance roller 115, a registration roller pair 116, the image forming unit 120, and a fixing unit 130.

The cassette 110 internally houses the sheets S. The cassette 110 includes a lift plate 111. The lift plate 111 inclines so as to push up the leading edge of the sheet S. The cassette 110 is extractable forward with respect to the housing 101.

The pickup roller 112 is located on the leading edge of the sheet S pushed up by the lift plate 111. Rotation of the pickup roller 112 pulls the sheet S out of the cassette 110.

The first feed roller 113 is located in the downstream side of the pickup roller 112 and further sends out the sheet S downstream. The second feed roller 114 is located in the inside (the rear side) of the fulcrum of the manual bypass tray 104A and pulls the sheet S on the manual bypass tray 104A inside the housing 101.

The conveyance roller 115 is located in the downstream side of a sheet conveyance direction of the first feed roller 113 and the second feed roller 114. The conveyance roller 115 further conveys the sheet S, which is sent out by the first feed roller 113 and the second feed roller 114, downstream.

The registration roller pair 116 has a function of correcting an oblique conveyance of the sheet S. This adjusts a position of an image to be formed on the sheet S. The registration roller pair 116 supplies the image forming unit 120 with the sheet S in accordance with timing of the image formation process by the image forming unit 120.

The image forming unit 120 includes a photoreceptor drum 121 (an image carrier), a charger 122, an exposure apparatus 123, a developing device 20, the toner container 30 (the developer housing container), a transfer roller 126, and a cleaning apparatus 127. As will be described later, the developing device 20 and the toner container 30 are integrally removably attachable with respect to the housing 101 as the developer unit 120H.

The photoreceptor drum 121 has a cylindrical shape and is rotatably supported to the housing 101. The photoreceptor drum 121 has a circumference surface where an electrostatic latent image is formed and carries a toner image (a developer image) corresponding to this electrostatic latent image on the circumference surface. The charger 122 applied with a predetermined voltage causes the circumference surface of the photoreceptor drum 121 to be approximately evenly charged.

The exposure apparatus 123 irradiates the circumference surface of the photoreceptor drum 121 charged by the charger 122 with a laser beam. This laser beam is irradiated in accordance with image data output from an external device such as a personal computer communicatively connected to the image forming apparatus 100. This results in forming the electrostatic latent image corresponding to the image data on the circumference surface of the photoreceptor drum 121. The exposure apparatus 123 is supported by a support frame 100H (see FIG. 2). The support frame 100H is a frame located inside the housing 101. The support frame 100H is located along the paper sheet discharge unit 102A inclined downward toward the rear. A frame front wall 100H1 is located upright at the front end portion of the support frame 100H. The frame front wall 100H1 is a wall portion extending in a vertical direction immediately below the paper sheet discharge unit 102A. The frame front wall 100H1 is located opposed to the toner container 30 (see FIG. 2).

The developing device 20 supplies toner (developer) onto the circumference surface of the photoreceptor drum 121 on which the electrostatic latent image is formed. The toner container 30 internally houses the toner and replenishes the toner to the developing device 20. The toner container 30 is located to be removably attachable with respect to the developing device 20. Supplying the toner onto the photoreceptor drum 121 by the developing device 20 develops (visualizes) the electrostatic latent image formed on the circumference surface of the photoreceptor drum 121. This results in forming the toner image on the circumference surface of the photoreceptor drum 121.

The transfer roller 126 is located facing the photoreceptor drum 121 while sandwiching the sheet conveyance path PP under the photoreceptor drum 121. The transfer roller 126 forms a transfer nip portion with the photoreceptor drum 121 and transfers the toner image to the sheet S.

The cleaning apparatus 127 removes the toner left on the circumference surface of the photoreceptor drum 121 after the toner image has been transferred to the sheet S.

The fixing unit 130 is located in the downstream side in the sheet conveyance direction with respect to the image forming unit 120 and fixes the toner image on the sheet S. The fixing unit 130 includes a heating roller 131 that melts the toner on the sheet S and a pressure roller 132 that causes the sheet S to be brought into close abutment on the heating roller 131.

The image forming apparatus 100 further includes a conveyance roller pair 133 located in the downstream side of the fixing unit 130 and a discharge roller pair 134 located in the downstream side of the conveyance roller pair 133. The sheet S is conveyed upward by the conveyance roller pair 133 and is finally discharged out of the housing 101 by the discharge roller pair 134. The sheet S discharged out of the housing 101 is stacked on the paper sheet discharge unit 102A.

Structure of Developer Unit

Figure 3:
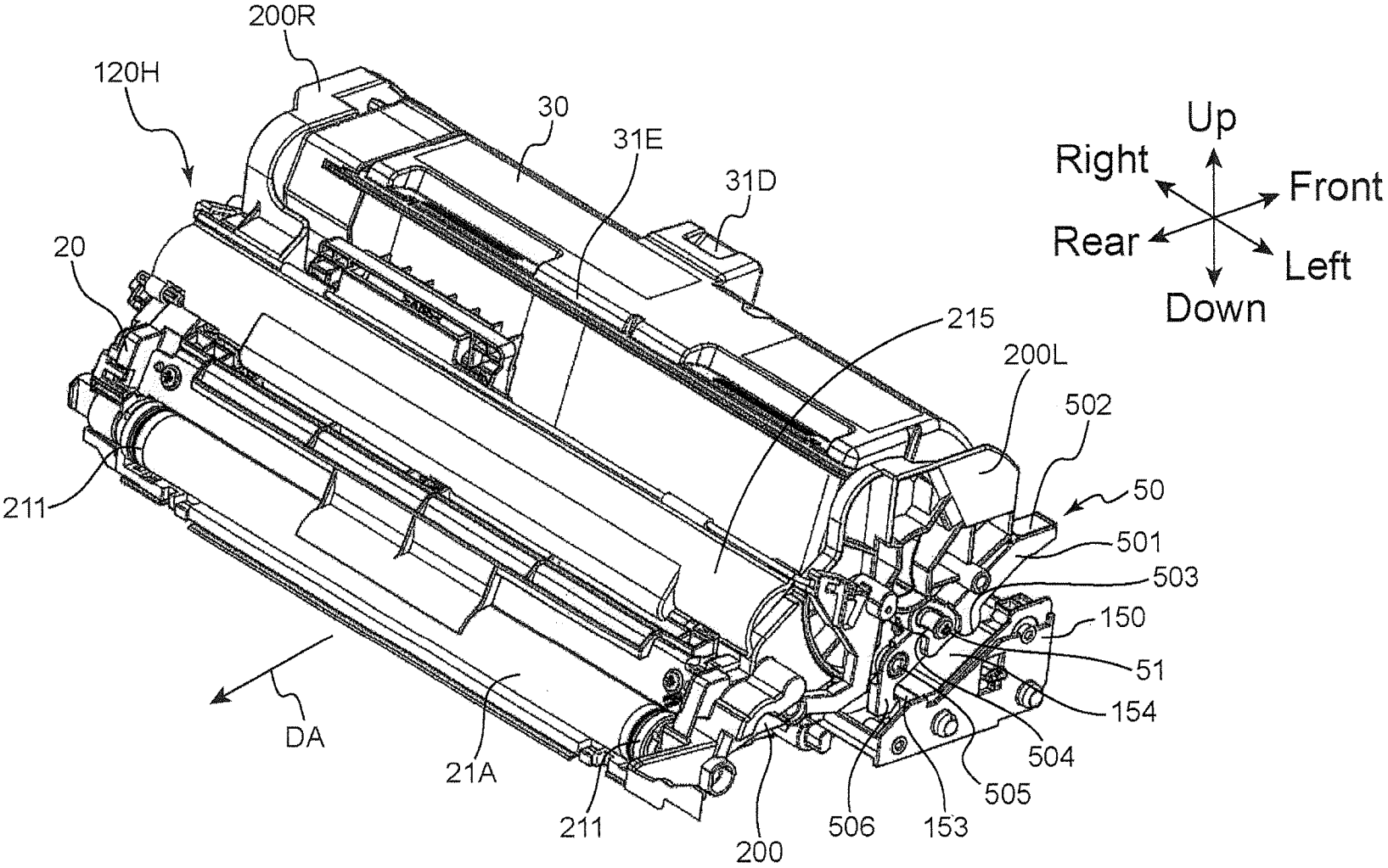
FIG. 3 illustrates a perspective view of a developer unit and a main body unit in the image forming apparatus.
Figure 4A:
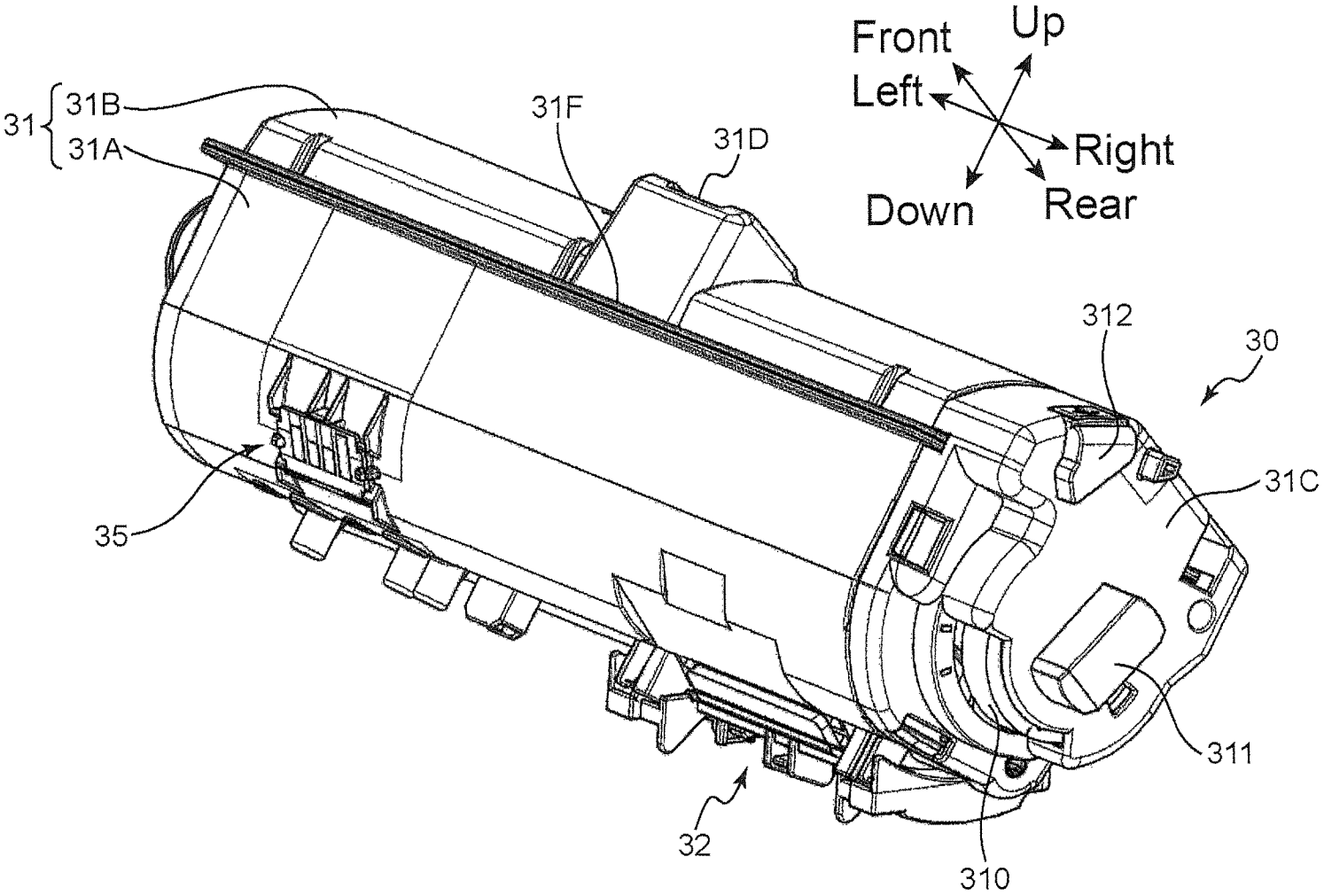
FIG. 4A illustrates a perspective view of a toner container in the image forming apparatus.
Figure 4B:
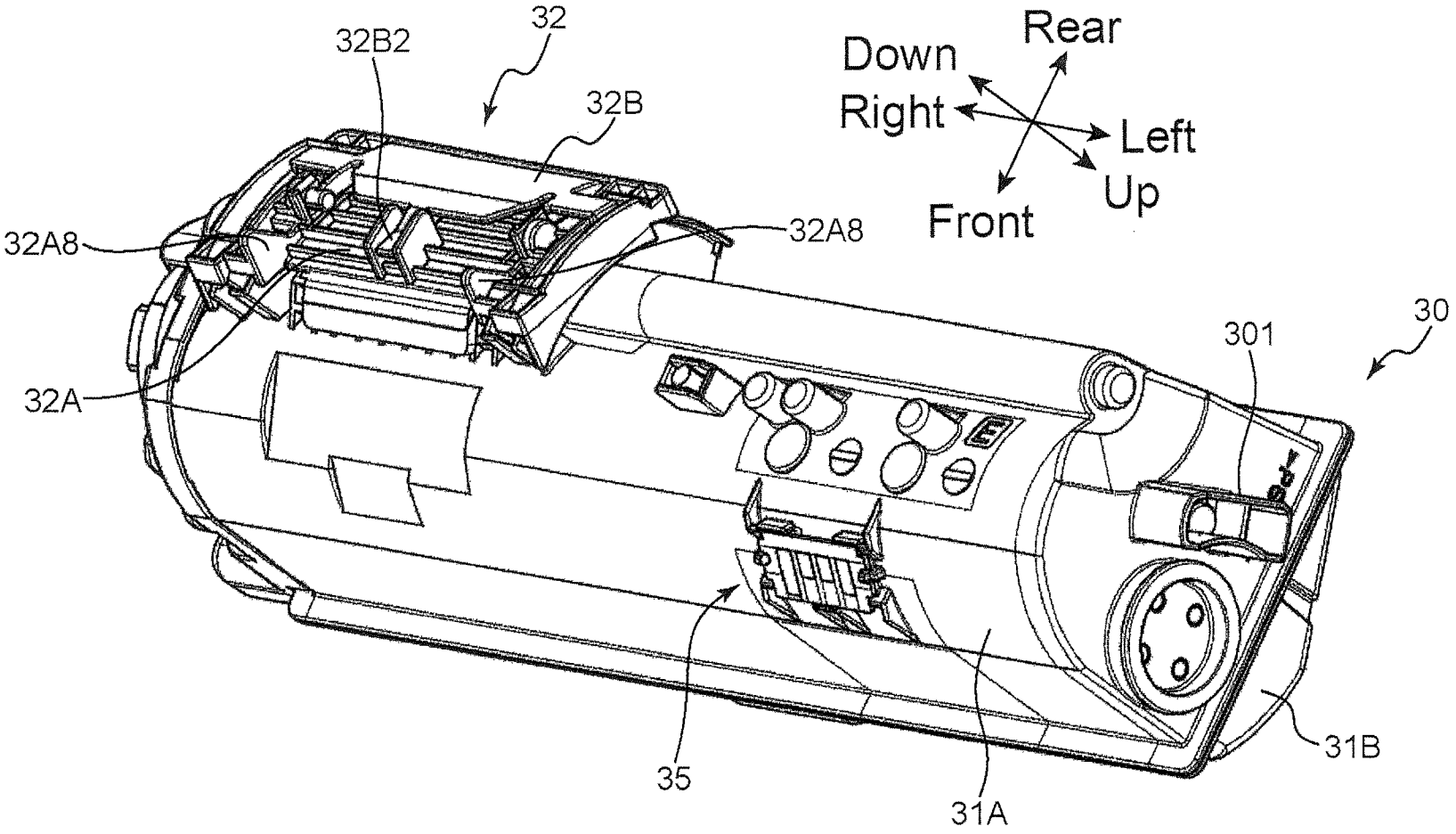
FIG. 4B illustrates a perspective view of the toner container in the image forming apparatus.
Figure 5:
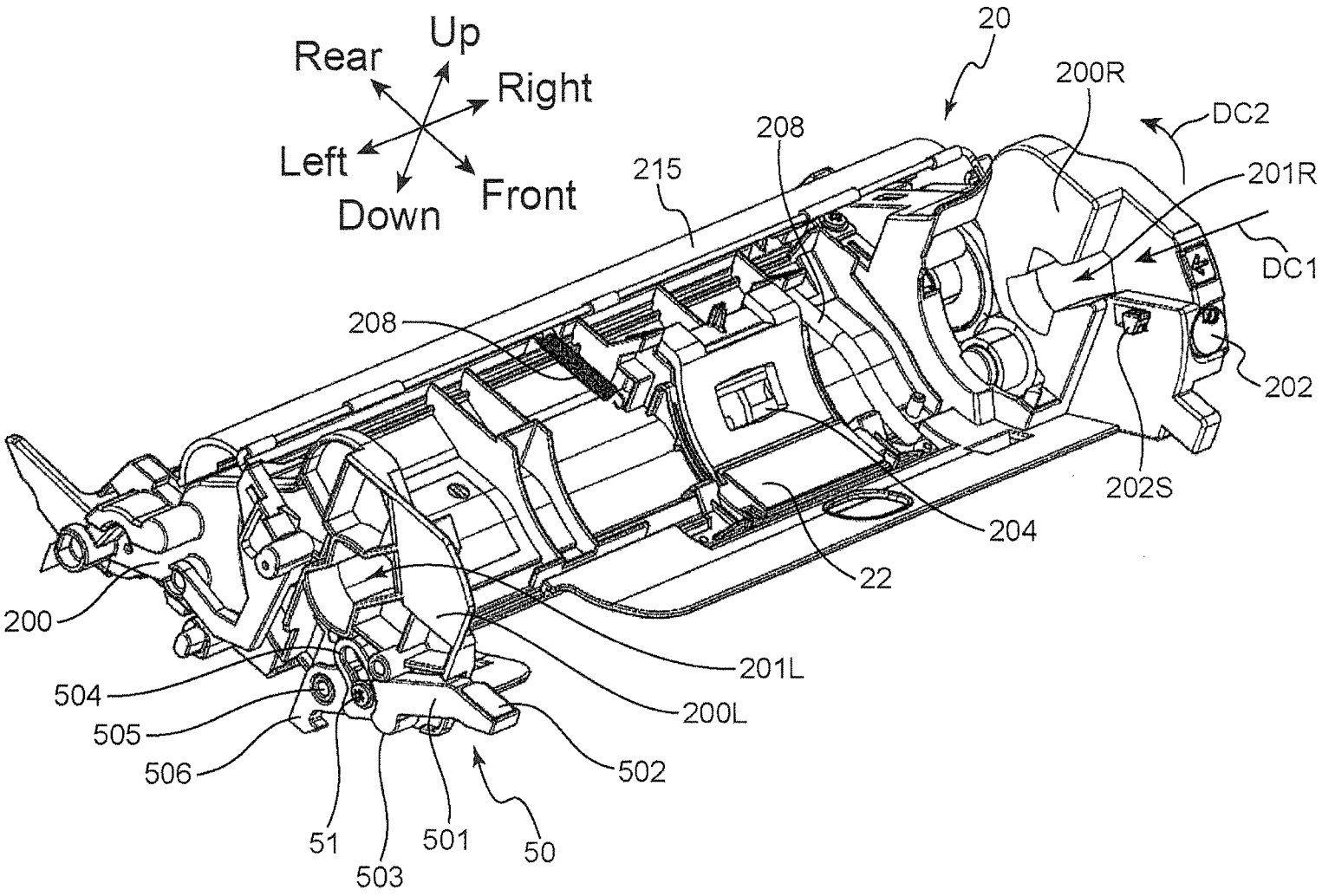
FIG. 5 illustrates a perspective view of a developing device in the image forming apparatus.
Figure 6:
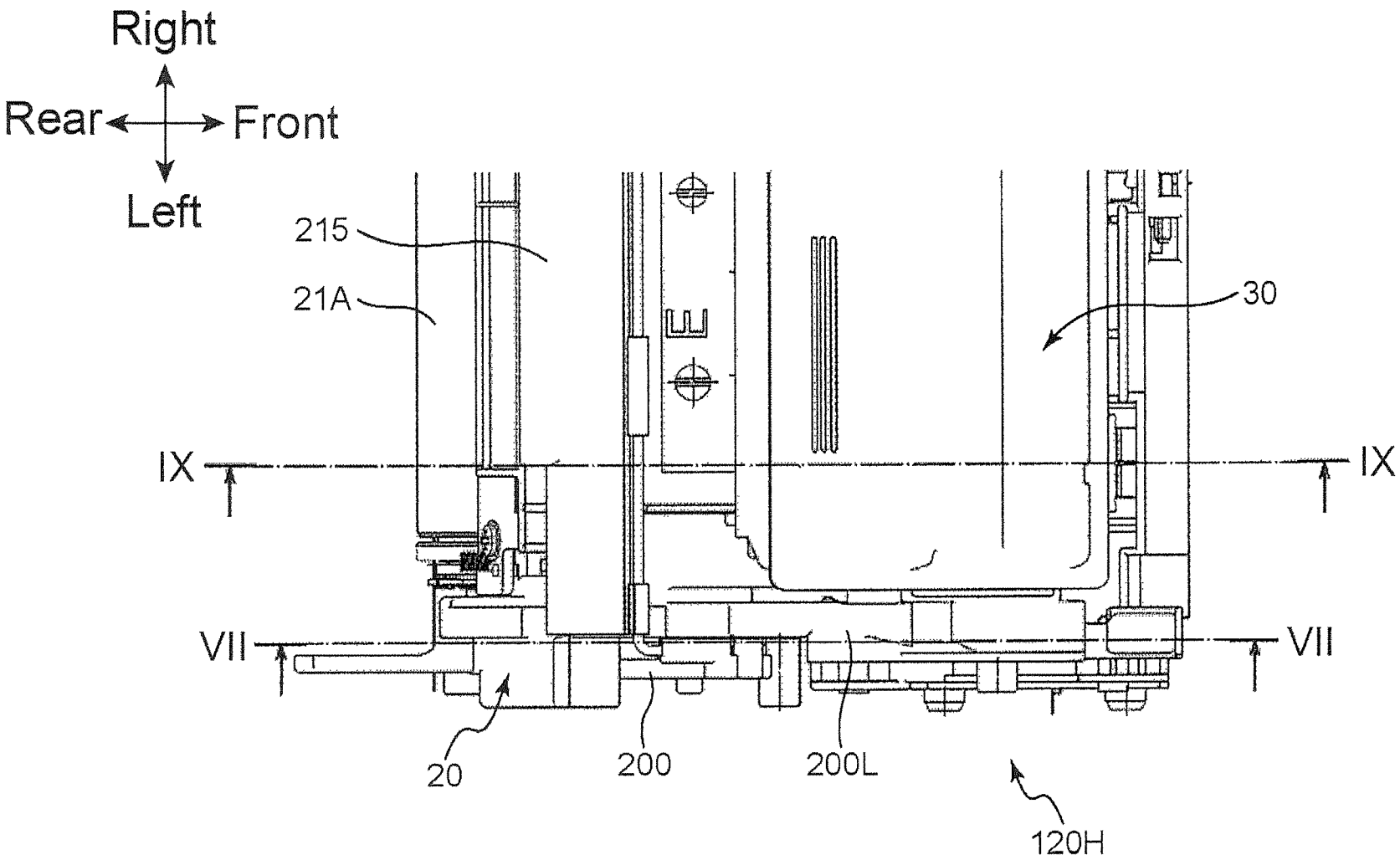
FIG. 6 illustrates a top view of a part of the developer unit in the image forming apparatus.

Next, referring to FIGS. 3 to 10, the following describes in detail the developer unit 120H (the developing device 20 and the toner container 30) according to the embodiment. FIG. 3 illustrates a perspective view of a developer unit 120H and a main body unit 150 (a part of the housing 101) in the image forming apparatus 100. FIGS. 4A and 4B illustrate perspective views of the toner container 30 in the image forming apparatus 100. FIG. 5 illustrates a perspective view of the developing device 20 in the image forming apparatus 100. FIG. 6 illustrates a top view of a part of the developer unit 120H in the image forming apparatus 100. FIGS. 7 to 10 illustrate cross-sectional views of the developer unit 120H and the main body unit 150 in the image forming apparatus 100. The respective cross-sectional views of FIGS. 7 and 8 correspond to the cross-sectional view at VIII-VIII line in FIG. 6, and the respective cross-sectional views of FIGS. 9 and 10 correspond to the cross-sectional view at IX-IX line in FIG. 6.

As described above, the developer unit 120H includes the developing device 20 and the toner container 30. The developer unit 120H is removably attachable along a predetermined attachment/detachment direction with respect to the housing 101. This results in that the toner container 30 is attachable to the housing 101, integrally with the developing device 20. When the developing device 20 is first mounted to the housing 101, the toner container 30 is removably attachably mounted to the developing device 20 inside the housing 101. An arrow DA in FIGS. 2 and 3 indicates an attachment direction of the developer unit 120H relative to the housing 101.

Further, the image forming apparatus 100 includes the main body unit 150 (see FIG. 3). The main body unit 150 is a part of the housing 101 and guides an entrance and attachment/detachment of the developer unit 120H (the developing device 20) to/from the main-body internal space 107. As illustrated in FIG. 1, opening the front cover 106 with respect to the housing 101 exposes the main body unit 150 outside the housing 101. The developer unit 120H is mounted in the main-body internal space 107 of the housing 101 such that the developer unit 120H passes through over the main body unit 150. As it appears in FIG. 3, the main body unit 150 has an approximately triangular shape from the side view and is a unit extending long in the lateral direction. The main body unit 150 includes positioning mechanisms 150S (see FIG. 9), an engaged portion 153 (see FIGS. 3 and 7), and a guide surface 154.

A pair of the positioning mechanisms 150S are located at both the end portions in the lateral direction of the main body unit 150. The positioning mechanism 150S includes an urging protrusion 151 and a unit urging spring 152. The urging protrusion 151 is brought into abutment on a housing pressed portion 200K (see FIG. 9) of the developer unit 120H mounted to the housing 101. The unit urging spring 152 urges the urging protrusion 151 toward the rear. In other words, the positioning mechanism 150S including the unit urging spring 152 urges the developer unit 120H that is mounted at a developing position inside the housing 101 toward the rear, and thus positions the developer unit 120H.

The guide surface 154 (see FIG. 7) is formed on the top surface portion of the main body unit 150. The guide surface 154 has a function of guiding the attachment of the developer unit 120H. The guide surface 154 has an inclined surface extending downward from the front toward the rear. Of the guide surface 154, the further rear end side of this inclined surface is a horizontal surface. The engaged portion 153 is located in the distal end side of the attachment direction (the arrow DA direction in FIG. 3) of the developer unit 120H with respect to the guide surface 154. A hook 506 (see FIG. 7) of a lock lever 50, which will be described later, is engageable with the engaged portion 153.

The toner container 30 internally houses the toner. As illustrated in FIG. 4A, the toner container 30 includes a container main body 31 (container body) and a container cover 31C. The container main body 31 has a shape extending in the lateral direction (the longitudinal direction). The container main body 31 includes a main unit 31A and a lid portion 31B. The main unit 31A defines a lower part of the container main body 31. The top surface portion of the main unit 31A has an opening.

The lid portion 31B is secured to the main unit 31A such that the lid portion 31B covers the opening of the top surface portion of the main unit 31A. In the embodiment, the lid portion 31B is welded and fixed to the main unit 31A. At this time, the main unit 31A and the lid portion 31B are secured at a container flange 31F, which is formed along a peripheral edge of the opening of the top surface portion of the main unit 31A. The lid portion 31B includes a first grip portion 31D and a second grip portion 31E (see FIG. 3). When the toner container 30 is mounted to the developing device 20 or when the developer unit 120H, which includes the toner container 30 and the developing device 20, is mounted to the housing 101, an operator is allowed to grip the first grip portion 31D and the second grip portion 31E.

The container cover 31C is mounted in the right side portion of the container main body 31. The container cover 31C includes a right-side guide 311, a transmission gear 310, and a lock engaging portion 312. The main unit 31A of the container main body 31 includes a left-side guide 301. The right-side guide 311 is a guide that is located to protrude from the container cover 31C and has an approximately rectangular parallelepiped shape. The left-side guide 301 with a shape identical to the right-side guide 311 is included in the side portion on the left side of the toner container 30 (see FIG. 4B). These guides guide the attachment of the toner container 30 to the developing device 20. The transmission gear 310 is a gear that transmits a rotary drive power to a container paddle 30K, which will be described later. The lock engaging portion 312 is a protrusion projected from the container cover 31C on a right-side surface of the container cover 31C spaced from the right-side guide 311. In a cross-sectional view intersecting with the lateral direction, the lock engaging portion 312 has an approximately trapezoidal shape. The lock engaging portion 312 is engageable with a lock abutment piece 202S (see FIG. 5).

Figure 9:
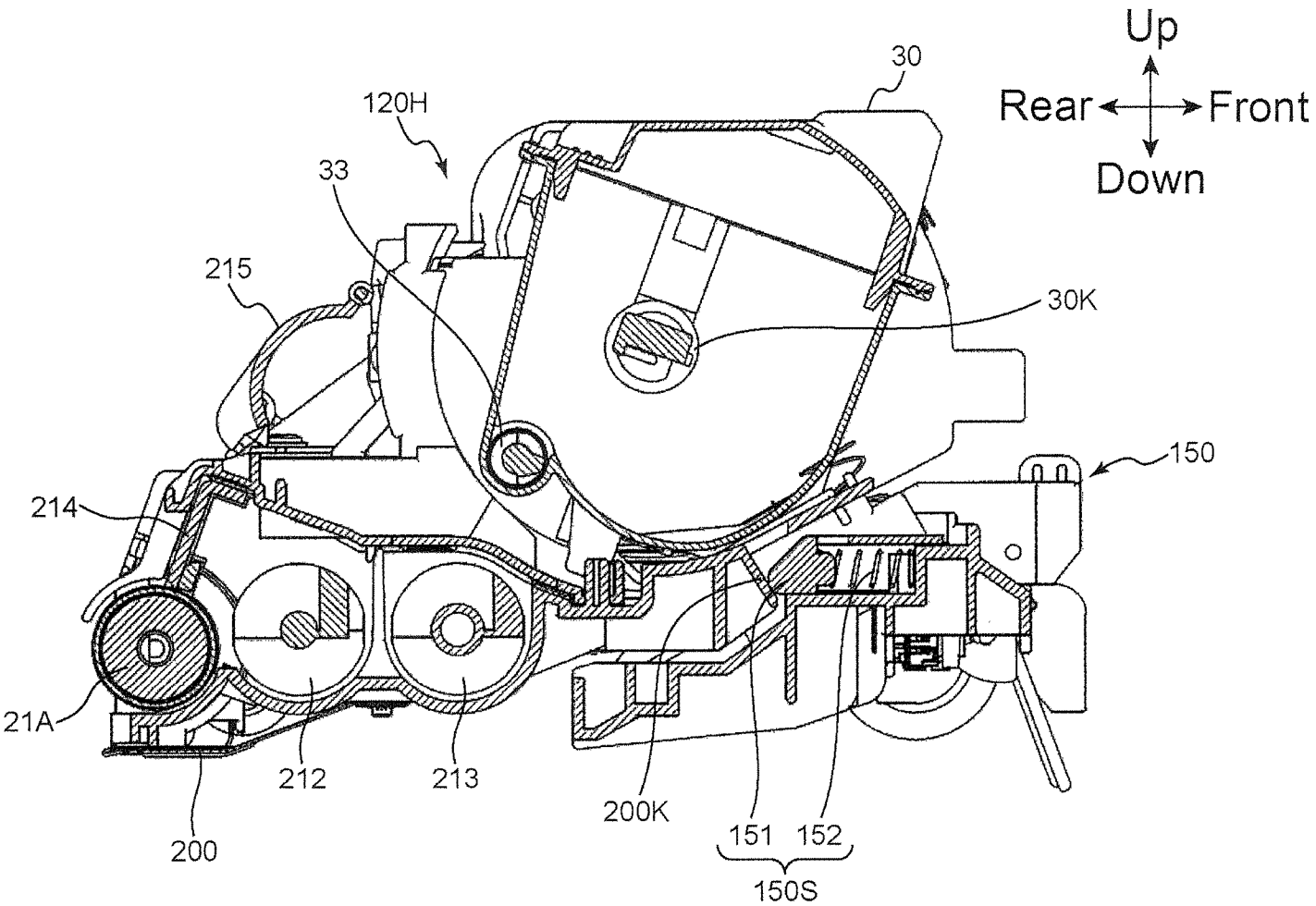
FIG. 9 illustrates a cross-sectional view of the developer unit and the main body unit in the image forming apparatus.

Further, the toner container 30 includes a container screw 33 and the container paddle 30K (see FIG. 9).

The container screw 33 is a screw located along the bottom portion of the main unit 31A. The bottom portion of the main unit 31A has a toner discharge port 30P, which will be described later, with an opening. The container screw 33 is rotationally driven and conveys the toner inside the container main body 31 to the toner discharge port 30P. Slidingly moving a container shutter 32, which will be described later, included in the container main body 31 opens the toner discharge port 30P and ensures discharge of the toner from the toner container 30. The container paddle 30K is rotatably supported inside the toner container 30 and stirs the toner housed inside the toner container 30.

The developing device 20 includes a development housing 200 (see FIG. 3), a developing roller 21A (see FIGS. 3 and 9), an abutting roller 211 (see FIG. 3), a first screw 212 (see FIG. 9), a second screw 213 (see FIG. 9), a layer thickness regulating member 214 (see FIG. 9), and a developing-roller cover 215.

The development housing 200 is a housing that supports the respective members of the developing device 20. The development housing 200 has a function to support the toner container 30. Referring to FIG. 5, the development housing 200 includes a housing-left-side wall 200L, a housing-right-side wall 200R, and a toner replenishment port 204. The housing-left-side wall 200L and the housing-right-side wall 200R are wall portions located upright from both the end portions in the lateral direction of the development housing 200. The toner container 30 is mounted between the housing-left-side wall 200L and the housing-right-side wall 200R.

The housing-right-side wall 200R includes a right-side guide groove 201R, the lock abutment piece 202S, and a lock button 202. The housing-left-side wall 200L includes a left-side guide groove 201L. The right-side guide groove 201R and the left-side guide groove 201L are guide grooves formed in the housing-right-side wall 200R and the housing-left-side wall 200L, respectively. These guide grooves are formed along the attachment direction (an arrow DC1 in FIG. 5) of the toner container 30 relative to the development housing 200. The above-described right-side guide 311 (see FIG. 4A) of the toner container 30 enters the right-side guide groove 201R. The left-side guide 301 (see FIG. 4B) included in the left side surface of the toner container 30 enters the left-side guide groove 201L. The toner container 30 is turned in an arrow DC2 direction in FIG. 5 after inserted over the development housing 200. This results in that the toner discharge port 30P of the toner container 30 faces the toner replenishment port 204, and this ensures toner replenishment to the developing device 20 from the toner container 30. The far-sides of the left-side guide groove 201L and the right-side guide groove 201R have a fan shape (see FIG. 5) to permit the rotations of the left-side guide 301 and the right-side guide 311. The following further describes an attachment structure of the toner container 30 to the development housing 200 in the developing device 20 in detail.

The lock abutment piece 202S locks the lock engaging portion 312 (see FIG. 4A) to lock the toner container 30 turned in the arrow DC2 direction. Pressing the lock button 202 releases the engagement of the lock abutment piece 202S and the lock engaging portion 312, releasing the lock of the lock abutment piece 202S on the lock engaging portion 312. This releases the lock of the toner container 30. This results in that the toner container 30 is turned in a direction opposite to the arrow DC2 direction in FIG. 5. This results in that the toner container 30 is detachable from the developing device 20 in a direction opposite to the arrow DC1 direction.

The developing roller 21A is rotatably supported to the development housing 200. The developing roller 21A carries developer constituted of toner on its circumference surface. The developing roller 21A supplies the toner onto the photoreceptor drum 121 and develops the electrostatic latent image on the photoreceptor drum 121. A pair of the abutting rollers 211 are located at both the end portions in the axial direction of the developing roller 21A. The abutting roller 211 holds a constant interval between the developing roller 21A and the photoreceptor drum 121 by being brought into abutment on the circumference surface of the photoreceptor drum 121.

The first screw 212 and the second screw 213 are screws rotatably supported inside the development housing 200. The developer inside the development housing 200 is circulatory conveyed by the first screw 212 and the second screw 213. The developer is supplied onto the developing roller 21A by the first screw 212. The layer thickness regulating member 214 regulates a layer thickness of the developer supplied onto the developing roller 21A. The developing-roller cover 215 is swingable with respect to the development housing 200. FIG. 3 illustrates a state where the developing-roller cover 215 has retreated over the developing roller 21A. Swinging the developing-roller cover 215 downward from the state illustrated in FIG. 3 ensures that the developing-roller cover 215 covers the developing roller 21A. Consequently, this prevents a foreign object from adhering on the developing roller 21A and prevents the peripheral area from being stained by the toner on the developing roller 21A when the developer unit 120H is detached from the housing 101.

Further, the developing device 20 includes the lock lever 50 (see FIGS. 3 and 5). The lock lever 50 is swingably located in the housing-left-side wall 200L of the developing device 20. The lock lever 50 takes a lock posture and a release posture. In the lock posture, the lock lever 50 locks the developer unit 120H (the developing device 20) at a developing position, which will be described later, inside the housing 101. In the release posture, the lock lever 50 releases the lock of the developer unit 120H and permits detachment of the developer unit 120H from the housing 101 along the predetermined attachment/detachment direction. The posture is changeable between the lock posture and the release posture.

Figure 7:
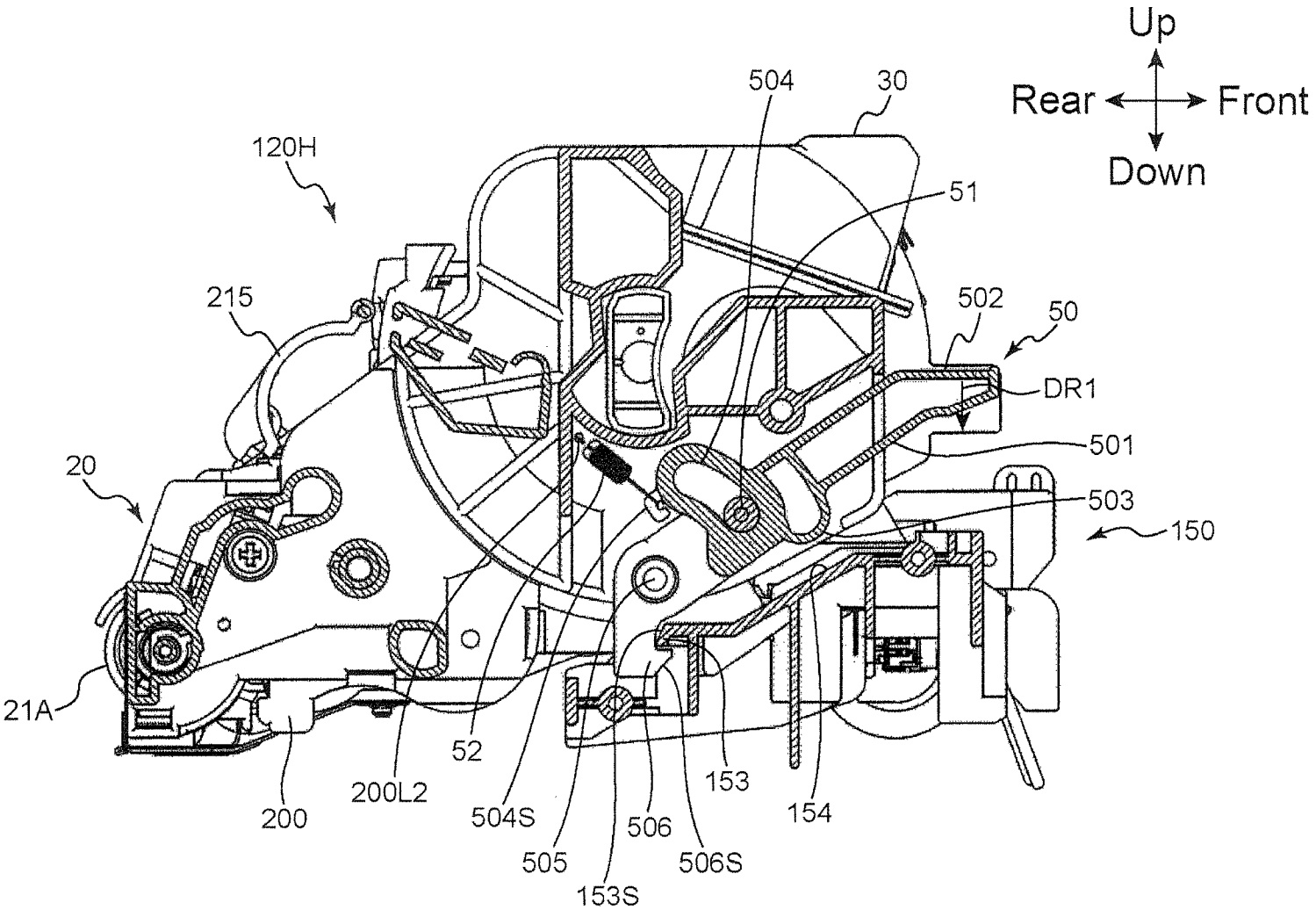
FIG. 7 illustrates a cross-sectional view of the developer unit and the main body unit in the image forming apparatus.

Referring to FIGS. 3, 5, and 7, the lock lever 50 includes a lever main body 501, a lever pressed portion 502, an abutting portion 503, a guide groove 504, a fulcrum 505, and the hook 506.

The lever main body 501 is a main body portion of the lock lever 50 and, as illustrated in FIG. 7, is located so as to obliquely extend from the front and upper side toward the rear and lower side. The lever pressed portion 502 is a flat portion provided on the upper end portion of the lever main body 501. The lever pressed portion 502 is pressed by an operator before the developer unit 120H is detached from the housing 101. The abutting portion 503 has a circular arc shape protruding downward, in the approximately center portion in the front-rear direction of the lock lever 50. As illustrated in FIGS. 3 and 7, mounting the developer unit 120H inside the housing 101 arranges that the abutting portion 503 faces the guide surface 154 of the main body unit 150. The guide groove 504 is a groove portion that opens in the rear of the abutting portion 503. The guide groove 504 opens so as to form a circular arc shape centered upon the fulcrum 505. The rear side of the guide groove 504 includes a lever-side lock portion 504S. The lever-side lock portion 504S has a hook shape located to protrude from the lock lever 50. One end of a lever-urging spring 52, which will be described later, is engagingly locked to the lever-side lock portion 504S.

The fulcrum 505 is located in the rear end side of the lock lever 50. The fulcrum 505 is rotatably supported to the housing-left-side wall 200L of the development housing 200. The fulcrum 505 is a fulcrum in swing of the lock lever 50. The above-described abutting portion 503 is located between the fulcrum 505 and the lever pressed portion 502 (see FIG. 7). The hook 506 is located in the opposite side to the lever pressed portion 502 with respect to the fulcrum 505. The hook 506 is engageable with the engaged portion 153 (see FIG. 7) of the main body unit 150. As illustrated in FIG. 7, the hook 506 extends downward from the fulcrum 505, and its distal end portion is bent forward (to the rear end side in the attachment direction of the developer unit 120H).

Further, the developing device 20 includes a guide screw 51 and the lever-urging spring 52 (see FIG. 7). The guide screw 51 is inserted into the guide groove 504 and is a screw fastened to the housing-left-side wall 200L. The guide screw 51 has a function to guide the swing of the lock lever 50 along the guide groove 504.

The lever-urging spring 52 is a spring member that expands and contracts between the housing-left-side wall 200L of the development housing 200 and a lever-urging spring 52. The above-described housing-left-side wall 200L includes a housing-side lock portion 200L2. As illustrated in FIG. 7, one end of the lever-urging spring 52 is engagingly locked to the lever-side lock portion 504S of the lever-urging spring 52, and the other end of the lever-urging spring 52 is engagingly locked to the housing-side lock portion 200L2. This results in that the lever-urging spring 52 urges the lock lever 50 around the fulcrum 505 such that the hook 506 engages with the engaged portion 153 (see FIG. 7).

Attachment/Detachment of Developer Unit

Next, the attachment/detachment of the developer unit 120H relative to the housing 101 will be described. As described above, the developer unit 120H is constituted of the developing device 20 and the toner container 30. The toner container 30 is removably attachable with respect to the developing device 20. The developer unit 120H is attachable to the housing 101 even with only the developing device 20 without including the toner container 30. Here, a description will be given of a state where the developer unit 120H including the toner container 30 is mounted and detached relative to the housing 101.

As illustrated in FIG. 1, when the front cover 106 of the housing 101 and the front end portion 102B of the upper wall 102 are opened, the developer unit 120H is mounted in the main-body internal space 107 of the housing 101. In this case, the developer unit 120H is inserted into the main-body internal space 107 along the arrow DA direction in FIGS. 2 and 3. The main body unit 150 (see FIG. 3) guides the lower portion of the developer unit 120H. In accordance with the attachment of the developer unit 120H, the hook 506 of the lock lever 50 moves rearward sliding on the guide surface 154. Afterward, an inclined surface 506S (see FIG. 7) of the hook 506 slidingly rubs against an inclined surface 153S of the engaged portion 153. In this case, in FIG. 7, slight clockwise turning of the hook 506 around the fulcrum 505 causes the distal end portion of the hook 506 to enter the lower side of the engaged portion 153 while the developer unit 120H moves downward. This results in that the hook 506 engages with the engaged portion 153, and the developer unit 120H is locked at the developing position illustrated in FIG. 7. At the developing position, the developing roller 21A of the developing device 20 is located facing the photoreceptor drum 121 with a predetermined interval. The posture of the lock lever 50 in FIG. 7 is defined as the lock posture of the lock lever 50. In this case, as illustrated in FIG. 9, the housing pressed portion 200K of the development housing 200 is pressed rearward by the urging protrusion 151 of the positioning mechanism 150S. That is, the positioning mechanism 150S urges the developer unit 120H toward a direction where the developing roller 21A approaches the photoreceptor drum 121. Then, positioning the developer unit 120H at the developing position in FIGS. 7 and 9 in the housing 101 causes the abutting roller 211 (see FIG. 3) to be brought into abutment on the circumference surface of the photoreceptor drum 121 and thus arranges the developing roller 21A at a predetermined interval with respect to the photoreceptor drum 121. This results in stable supply of toner from the developing roller 21A onto the photoreceptor drum 121 and formation of toner images on the photoreceptor drum 121.

Figure 8:
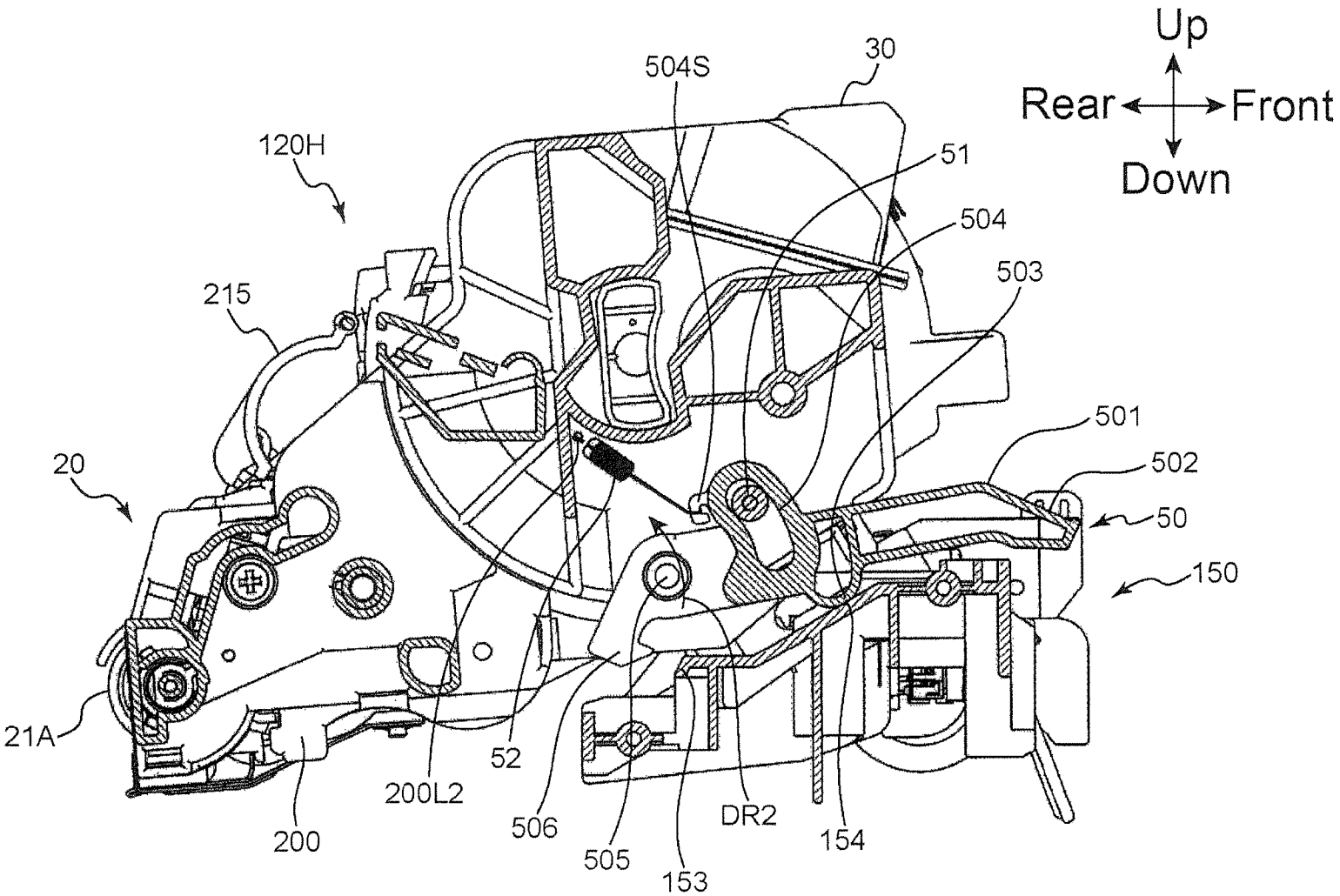
FIG. 8 illustrates a cross-sectional view of the developer unit and the main body unit in the image forming apparatus.
Figure 10:
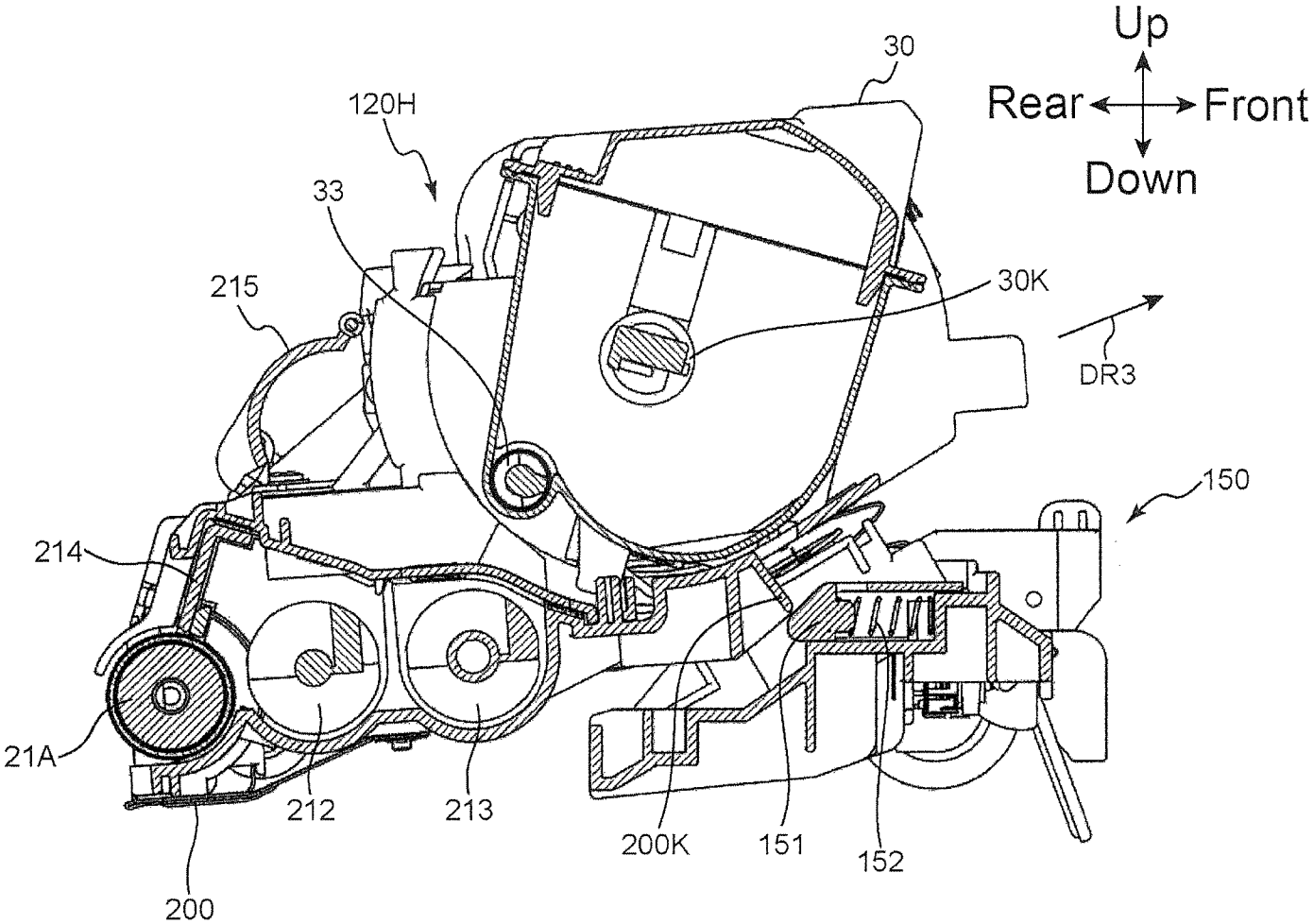
FIG. 10 illustrates a cross-sectional view of the developer unit and the main body unit in the image forming apparatus.

When the developer unit 120H is detached from the housing 101, as illustrated in FIG. 1, opening the front cover 106 of the housing 101 and the front end portion 102B of the upper wall 102 exposes the lever pressed portion 502 of the lock lever 50 outside the image forming apparatus 100. An operator first presses the lever pressed portion 502 downward (an arrow DR1 in FIG. 7). This results in that the lock lever 50 swings around the fulcrum 505 against the urging force of the lever-urging spring 52 and takes the release posture illustrated in FIG. 8. In this case, engagement of the hook 506 with the engaged portion 153 is released. Further pressing the lever pressed portion 502 causes the abutting portion 503 of the lock lever 50 to be brought into abutment on the guide surface 154, as illustrated in FIG. 8. Then, the developer unit 120H is pushed up to a standby position upper than the developing position illustrated in FIG. 7, with this abutting portion 503 as the fulcrum and the fulcrum 505 being a load point (an arrow in FIG. 1 and an arrow DR2 in FIG. 8). As illustrated in FIG. 10, this results in that the housing pressed portion 200K goes on the inclined surface of the urging protrusion 151, and the positioning of the developer unit 120H by the positioning mechanism 150S is released. In this case, the urging force from the positioning mechanism 150S (the unit urging spring 152) is not strongly applied to the development housing 200. Consequently, this ensures easy detachment of the developer unit 120H from the housing 101 along the above-described attachment/detachment direction (an arrow DR3 in FIG. 10).

As illustrated in FIG. 8, after the developer unit 120H has been pushed up in the arrow DR2 direction, bringing the hook 506 in abutment on the guide surface 154 on the upper side of the engaged portion 153 by the own weight of the developer unit 120H holds the developer unit 120H at the standby position. Consequently, even when the operator releases his/her hand from the lock lever 50, this prevents the hook 506 from engaging again with the engaged portion 153. This ensures that the operator easily and surely detaches the developer unit 120H.

In other embodiments, when the developer unit 120H is pushed up to the standby position, the inclined surface 506S (see FIG. 7) of the hook 506 may be in abutment on the inclined surface 153S of the engaged portion 153. In this case as well, the lock lever 50 is turnable around the fulcrum 505 in accordance with pulling-out operation (the arrow DR3 in FIG. 10) of the developer unit 120H. This similarly prevents the hook 506 from engaging again with the engaged portion 153.

Structures of Toner Container and Developing Device

Figure 11A:
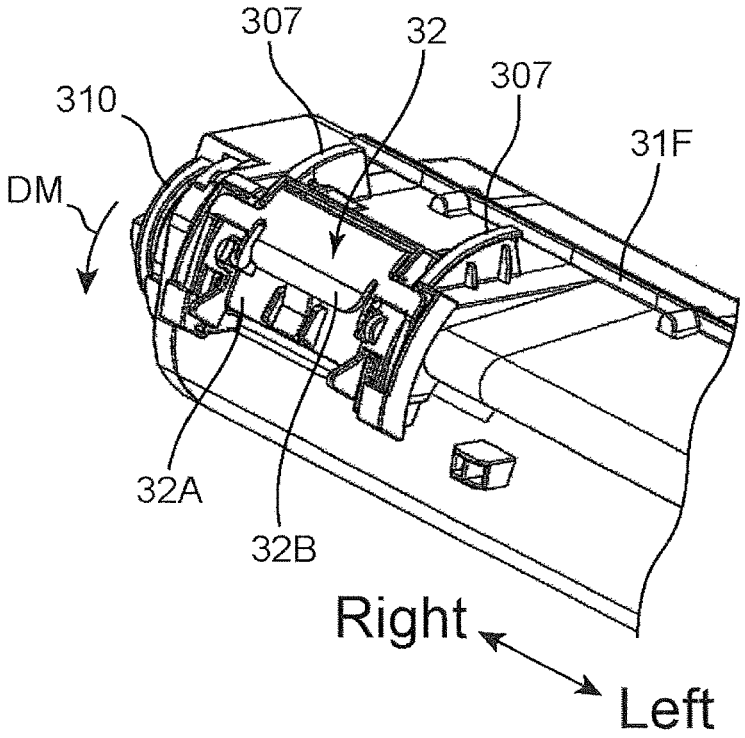
FIG. 11A illustrates a perspective view of an enlarged proximity of a toner discharge port of a toner container in the image forming apparatus.
Figure 11B:
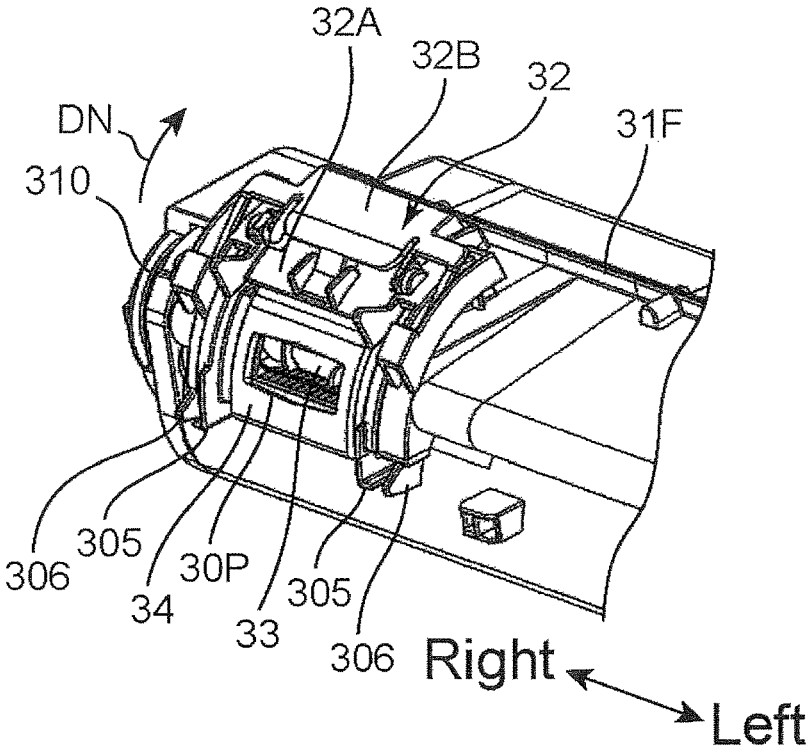
FIG. 11B illustrates a perspective view of the enlarged proximity of the toner discharge port of the toner container in the image forming apparatus.
Figure 12:
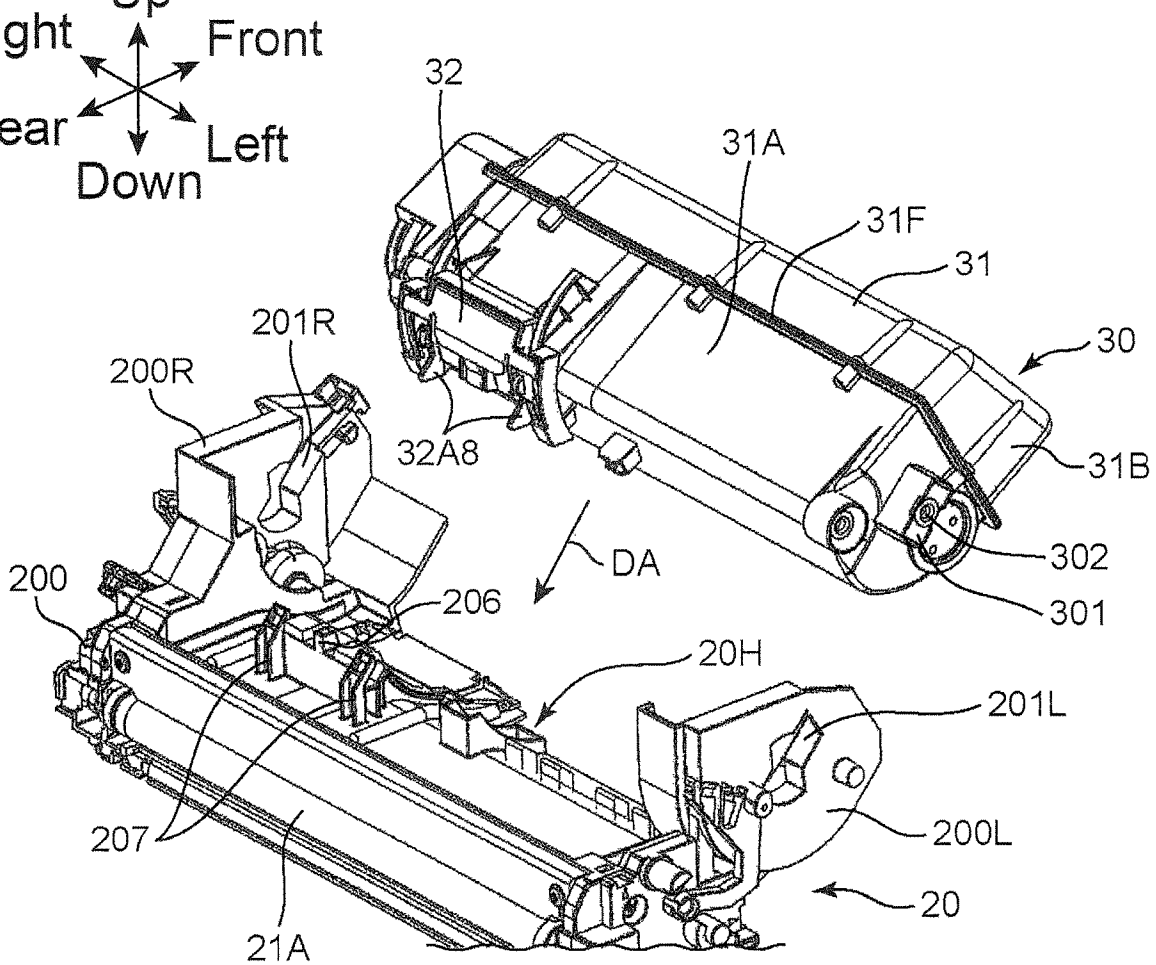
FIG. 12 illustrates a perspective view of a state where the toner container is being mounted on the developing device.

The following further describes the structures of the toner container 30 and the developing device 20 according to the embodiment in detail. FIGS. 11A and 11B illustrate perspective views of an enlarged proximity of the toner discharge port 30P of the toner container 30. FIG. 11A illustrates a state that the container shutter 32 shuts the toner discharge port 30P. FIG. 11B illustrates the open toner discharge port 30P. FIG. 12 illustrates a perspective view of a state where the toner container 30 is being mounted to the developing device 20.

The toner container 30 has a longitudinal shape extending in one direction. The toner container 30 is mounted to the developing device 20 inside the housing 101 such that the longitudinal direction of the toner container 30 goes along the lateral direction. In addition to the above-described container main body 31, the toner container 30 includes the container shutter 32 (see FIGS. 4B and 11A), the toner discharge port 30P (see FIG. 11B), a paddle bearing portion 302 (see FIG. 12), container shutter pressing portions 305 (see FIG. 11B), elastic piece pressing portions 306 (see FIG. 11B), guide ribs 307 (see FIG. 11A), and the transmission gear 310 (see FIGS. 4A and 11A).

The toner discharge port 30P (see FIG. 11B) is an opening open to a right edge side on a lower surface of the main unit 31A. The toner housed inside the toner container 30 is discharged from the toner discharge port 30P and is supplied onto the developing device 20.

The above-described left-side guide 301 is a protrusion with longitudinal shape formed to extend in a predetermined direction at the left side surface of the main unit 31A. The above-described left-side guide 301 regulates the toner container 30 to move in a mounting direction to the developing device 20 (an arrow DA direction in FIG. 12). The left-side guide 301 internally has a cavity. The paddle bearing portion 302 (see FIG. 12) is a bearing portion located inside the left-side guide 301. The paddle bearing portion 302 rotatably journals the container paddle 30K. The right-side guide 311 also internally includes a bearing portion similar to the paddle bearing portion 302 on the left-side guide 301 side. The bearing portion is adjacent to the transmission gear 310 and journals a shaft portion of the container paddle 30K.

The container shutter pressing portions 305 (see FIG. 11B) are a pair of ribs protruded so as to sandwich a discharge protrusion 34, which has the toner discharge port 30P, in the longitudinal direction (the lateral direction) of the toner container 30. The container shutter pressing portions 305 are located downstream in a turning direction (a forward direction, an arrow DM in FIG. 11A) of the toner container 30 during the posture change with respect to the toner discharge port 30P. The pair of container shutter pressing portions 305 each extend along the turning direction. The container shutter pressing portions 305 have a shape whose distal end portions are bent along the longitudinal direction of the toner container 30 (each so as to expand in the lateral direction). The container shutter pressing portions 305 have a function of pressing a main body shutter 22, which will be described later, and being pressed by the main body shutter 22.

The elastic piece pressing portions 306 (see FIG. 11B) are pair of projection pieces adjacent to the container shutter pressing portions 305 and protruded from the main unit 31A. A pair of the elastic piece pressing portions 306 are located so as to sandwich the pair of container shutter pressing portions 305 in the lateral direction. The elastic piece pressing portions 306 extend along the above-described turning direction of the toner container 30. The elastic piece pressing portions 306 have an inclined shape whose projection height heightens as away from the toner discharge port 30P. The elastic piece pressing portions 306 are opposed to an elastic piece of a shutter stopper 32B, which will be described later, and have a function of pressing the elastic piece.

The guide ribs 307 (see FIG. 11A) are pair of arc-shaped rib members protruded from the main unit 31A and connected to the container shutter pressing portions 305. The guide ribs 307 are formed extending along the turning direction of the toner container 30. A pair of the guide ribs 307 are located so as to sandwich the toner discharge port 30P in the lateral direction. Outer peripheral portions of a pair of the guide ribs 307 each bend in the lateral direction and have a predetermined width. The guide ribs 307 guide the container shutter 32, which will be described later, slidably movable around a predetermined axis center.

The transmission gear 310 (see FIGS. 4A and 11A) is a rotation gear rotatably supported to the right side surface of the toner container 30. The transmission gear 310 has a function of transmitting rotary drive power to the container paddle 30K. Mounting the toner container 30 to the developing device 20 connects a gear group (not illustrated) of the developing device 20 to the transmission gear 310, thus the rotary drive power is input to the transmission gear 310.

The container shutter 32 (see FIG. 11A) is supported to the container main body 31 so as to be slidably movable with respect to the toner discharge port 30P to seal or open the toner discharge port 30P (see FIGS. 11A and 11B). The container shutter 32 slidably moves along the turning direction of the toner container 30 during the posture change. The container shutter 32 includes a shutter main body 32A and the shutter stopper 32B. The shutter stopper 32B is swingably supported to the shutter main body 32A.

The shutter main body 32A is an approximately rectangular-shaped member that has a curved surface along a circumference surface of the container main body 31. The shutter main body 32A seals the toner discharge port 30P. The shutter stopper 32B is mounted to a surface of the shutter main body 32A on a side opposite from a surface for sealing the toner discharge port 30P. The shutter stopper 32B has a function to regulate or permit a slidable movement of the container shutter 32.

Referring to FIG. 12, the developing device 20 includes a container mounting portion 20H between the housing-right-side wall 200R and the housing-left-side wall 200L. The toner container 30 is removably mounted to the container mounting portion 20H.

Further, in the developing device 20, the development housing 200 includes a stopper pressing portion 206 (see FIG. 12), container shutter securing portions 207 (see FIG. 12), and shutter springs 208 (see FIG. 5).

The stopper pressing portion 206 (see FIG. 12) is a protrusion protruded from a top panel of the development housing 200 adjacent to a rear side of the toner replenishment port 204. When the toner container 30 is mounted to the container mounting portion 20H, the stopper pressing portion 206 has a function of pressing a stopper releasing piece 32B2 (see FIG. 4B) on the container shutter 32 of the toner container 30. In other words, the stopper pressing portion 206 permits the slidable movement of the container shutter 32.

The container shutter securing portions 207 (see FIG. 12) are protrusions protruded from the top panel of the development housing 200 so as to sandwich the stopper pressing portion 206 in the lateral direction. In a cross-sectional view intersecting with the lateral direction, the container shutter securing portions 207 have an approximately trapezoidal shape. Wedge-shaped cutouts are formed on front side surfaces of the container shutter securing portions 207. When the toner container 30 is mounted to the container mounting portion 20H, shutter engaging pieces 32A8 (see FIG. 4B), which are on the container shutter 32 of the toner container 30, engage the cutouts. Consequently, the container shutter securing portions 207 secure the container shutter 32 and regulate the movement (turning) of the container shutter 32.

The shutter springs 208 (see FIG. 5) are pair of spring members located outside a pair of the container shutter securing portions 207 in the lateral direction. The shutter springs 208 extend in a front-rear direction. One ends of the shutter springs 208 are locked to the top panel of the development housing 200. The other ends of the shutter springs 208 are locked to the main body shutter 22 (see FIG. 5), which will be described later.

Further, the developing device 20 includes the main body shutter 22 (see FIG. 5). The main body shutter 22 is supported to the development housing 200 slidably movable to the toner replenishment port 204. The main body shutter 22 seals or opens the toner replenishment port 204.

The above-described shutter springs 208 urge the main body shutter 22 in a direction that the main body shutter 22 seals the toner replenishment port 204 (see FIG. 5). Accordingly, as illustrated in FIG. 12, with the toner container 30 removed from the developing device 20, the main body shutter 22 receives urging force from the shutter springs 208 to seal the toner replenishment port 204.

Posture Change of Toner Container Mounted to Developing Device

Figure 13A:
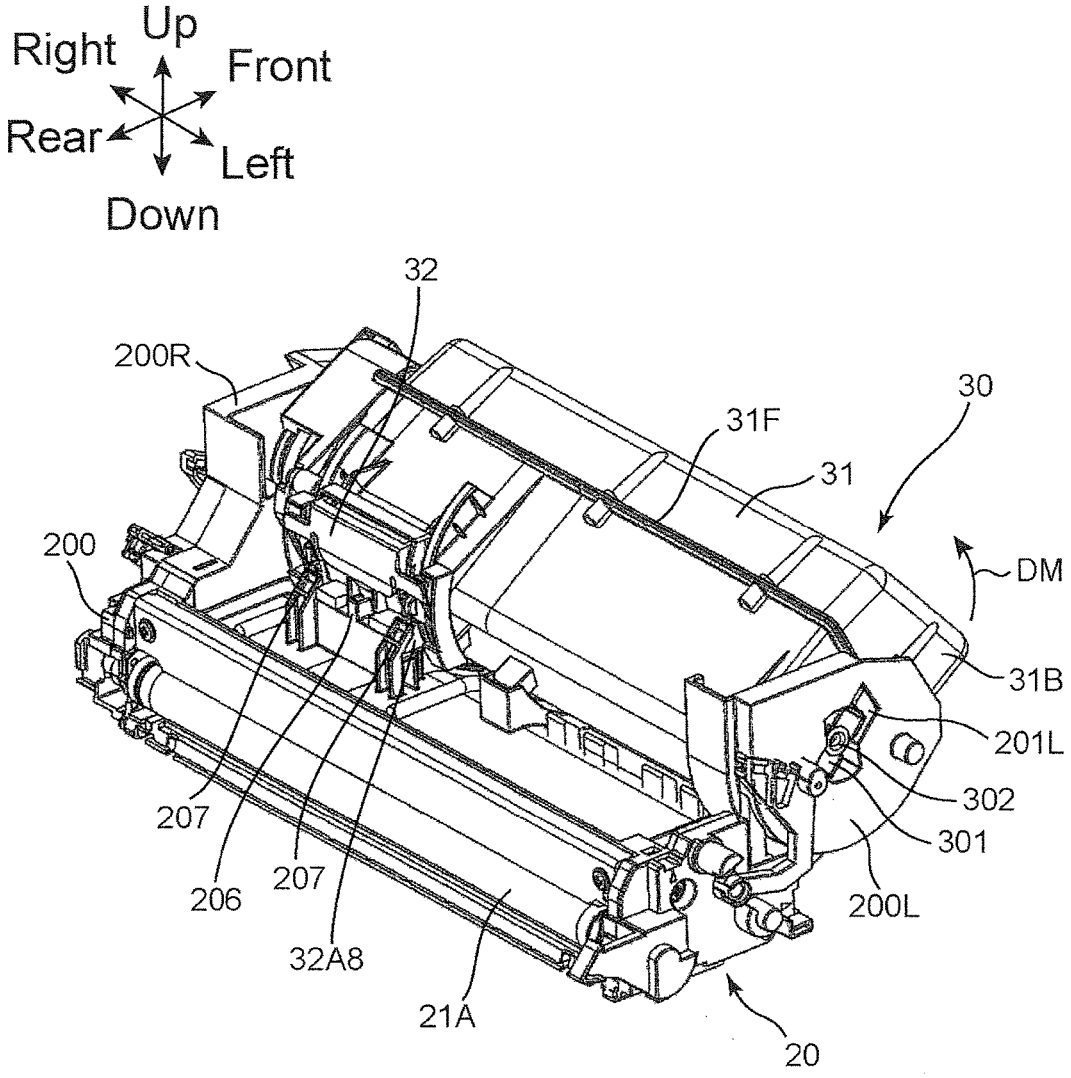
FIG. 13A illustrates a perspective view of a state where the toner container mounted to the developing device is held in a first posture.
Figure 13B:
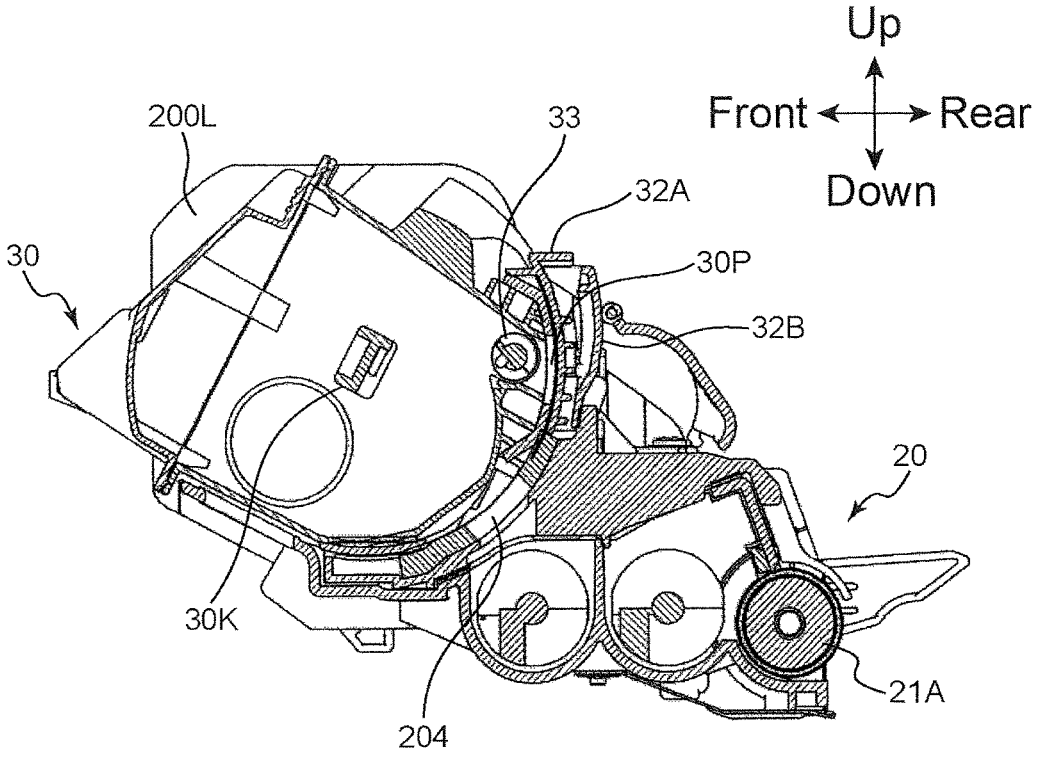
FIG. 13B illustrates a cross-sectional view of a state where the toner container mounted to the developing device is held in the first posture.
Figure 14A:
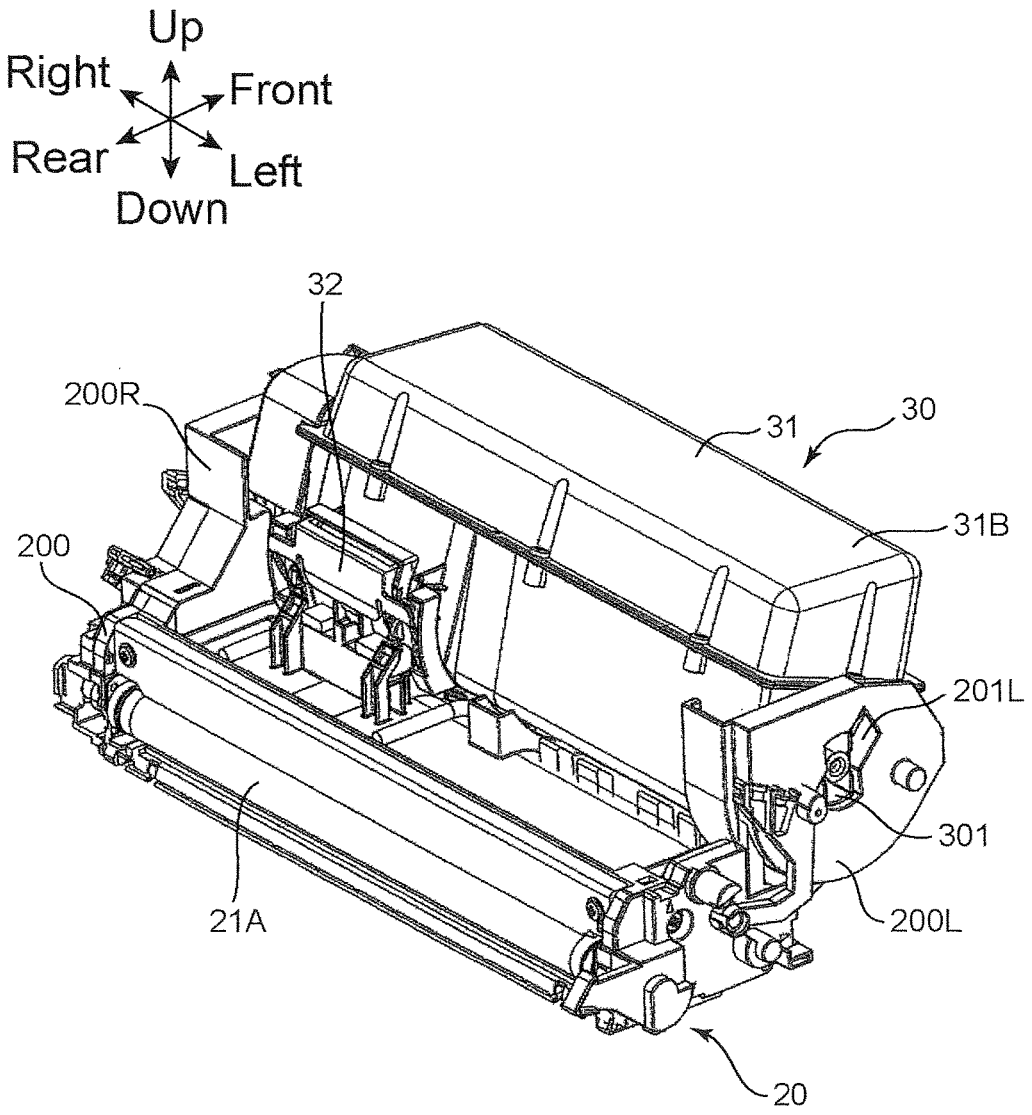
FIG. 14A illustrates a perspective view of a state where the toner container mounted to the developing device is held in a second posture.
Figure 14B:
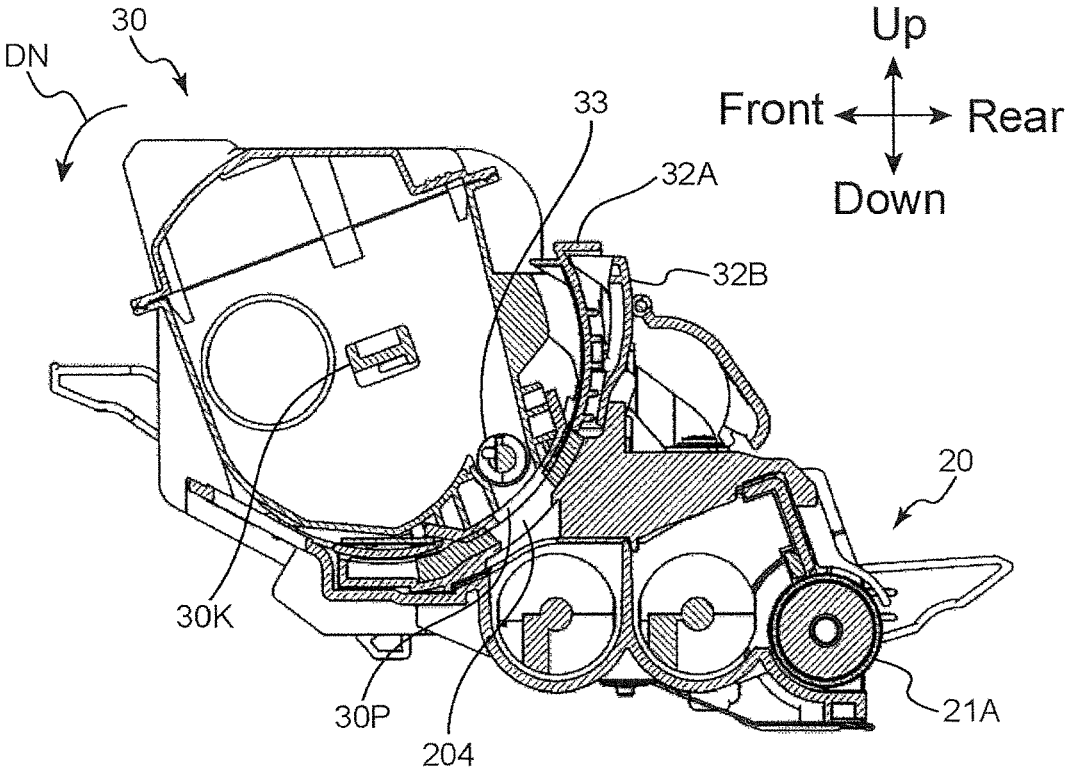
FIG. 14B illustrates a cross-sectional view of a state where the toner container mounted to the developing device is held in the second posture.

The following describes the posture change of the toner container 30 mounted to the developing device 20. FIGS. 13A and 13B illustrate a state where the toner container 30 mounted to the developing device 20 is held in a first posture. FIG. 13A illustrates a perspective view, and FIG. 13B illustrates a cross-sectional view. FIGS. 14A and 14B illustrate a state where the toner container 30 mounted to the developing device 20 is held in a second posture. FIG. 14A illustrates a perspective view, and FIG. 14B illustrates a cross-sectional view.

As described above, in this embodiment, with the developing device 20 mounted to the housing 101 first, the toner container 30 alone is removably attachable to the developing device 20. Even if the toner container 30 becomes empty, the toner container 30 can be easily exchanged. If the container shutter 32 is slidably moved from a position of covering the toner discharge port 30P by mistake before the toner container 30 is mounted to the developing device 20, the toner leaks out of the toner discharge port 30P. This embodiment prevents the slidable movement of the container shutter 32 from the toner discharge port 30P while the toner container 30 alone is mounted.

The toner container 30 is mounted to the container mounting portion 20H of the developing device 20 while the left-side guide 301 and the right-side guide 311 are inserted into the left-side guide groove 201L and the right-side guide groove 201R respectively so as to be guided along the mounting direction (the arrow DA direction in FIG. 12) by the left-side guide groove 201L and the right-side guide groove 201R. This holds the toner container 30 immediately after mounted to the container mounting portion 20H in the first posture illustrated in FIGS. 13A and 13B. In the first posture, as illustrated in FIG. 13B, the toner discharge port 30P of the toner container 30 is located separately on the upper side of the toner replenishment port 204 of the developing device 20, and the toner discharge port 30P does not communicate with the toner replenishment port 204 yet.

In the first posture, the stopper pressing portion 206 on the development housing 200 presses the stopper releasing piece 32B2 (see FIG. 4B) on the shutter stopper 32B. This releases the lock to the container shutter 32 by the shutter stopper 32B, ensuring the slidable movement of the container shutter 32 to the container main body 31. Further, in the first posture, a pair of the shutter engaging pieces 32A8 of the shutter main body 32A of the container shutter 32 engage with wedge-shaped cutout portions of the container shutter securing portions 207 (see FIG. 13A).

With the toner container 30 mounted to the container mounting portion 20H of the developing device 20, the posture of the toner container 30 is changeable between the first posture illustrated in FIGS. 13A and 13B, and the second posture illustrated in FIGS. 14A and 14B. In this embodiment, the toner container 30 is turnable in both forward and reverse directions around a predetermined axis (around the axis center of the container paddle 30K (see FIG. 13B)) in a state where the toner container 30 is mounted to the container mounting portion 20H of the developing device 20. Turning the toner container 30 in the forward direction (the arrow DM direction in FIG. 13A, hereinafter referred to as "a forward direction DM") from the first posture changes the posture to the second posture. Turning the toner container 30 in the reverse direction (the arrow DN direction in FIG. 14B, hereinafter referred to as "a reverse direction DN") from the second posture changes the posture to the first posture.

When the toner container 30 is turned in the forward direction DM from the first posture, the posture is changed to the second posture while the toner discharge port 30P is slidably moved with respect to the container shutter 32 secured to the container shutter securing portion 207. In this second posture, as illustrated in FIG. 14B, the toner discharge port 30P of the toner container 30 communicates with the toner replenishment port 204 of the developing device 20. This ensures the toner replenishment from the toner container 30 to the developing device 20.

With the toner container 30 not mounted to the container mounting portion 20H, the main body shutter 22 seals the toner replenishment port 204. When the toner container 30 is turned in the forward direction DM as described above and the posture is changed from the first posture to the second posture, a part of the toner container 30 presses the main body shutter 22 in the forward direction DM against the urging force from the shutter springs 208 (see FIG. 5). This slidably moves the main body shutter 22 in the forward direction DM together with the container main body 31 of the toner container 30 and as illustrated in FIG. 14B, the toner replenishment port 204 is open. Accordingly, the toner discharge port 30P and the toner replenishment port 204 are vertically communicatable.

With the toner container 30 mounted to the container mounting portion 20H in the second posture, the lock abutment piece 202S (see FIG. 5) engages with the lock engaging portion 312 (see FIG. 4A). Consequently, the lock abutment piece 202S locks the toner container 30 in the second posture. With this locked state, even if the urging force from the shutter springs 208 (see FIG. 5) reaches the toner container 30 via the main body shutter 22, the lock abutment piece 202S regulates the turning of the toner container 30. This restrains the turning of the toner container 30 in the reverse direction DN, that is, this restrains changing the posture of the toner container 30 from the second posture to the first posture.

On the other hand, when a sensor (not illustrated) detects the empty toner in the toner container 30, a display (not illustrated) on the image forming apparatus 100 notifies an exchange display for the toner container 30. When the user of the image forming apparatus 100 presses the lock button 202 (see FIG. 5), the lock abutment piece 202S moves rearward. This separates the lock abutment piece 202S from the lock engaging portion 312 rearward, thus releasing the engagement between the lock abutment piece 202S and the lock engaging portion 312. This loses the regulating force regulating the lock engaging portion 312, thereby releasing the lock of the toner container 30. Since the urging forces from the shutter springs 208 are given to the main body shutter 22, the toner container 30 turns in the reverse direction DN while the main body shutter 22 presses the toner container 30. Consequently, the toner container 30 automatically changes the posture from the second posture to the first posture by the urging force from the shutter springs 208.

The posture change of the toner container 30 from the second posture to the first posture turns the toner discharge port 30P in the reverse direction DN, and the toner discharge port 30P is re-sealed by the container shutter 32. The urging force from the shutter springs 208 slidably moves the main body shutter 22, thus re-sealing the toner replenishment port 204 by the main body shutter 22.

The toner container 30 with the posture changed from the second posture to the first posture is detached from the container mounting portion 20H along a direction opposite from the mounting direction, thus removing the toner container 30 from the developing device 20. Thus, in this embodiment, releasing the lock of the toner container 30 changes the posture of the toner container 30 from the second posture to the first posture. Then, the container shutter 32 and the main body shutter 22 seal the toner discharge port 30P and the toner replenishment port 204, respectively. When the user removes the toner container 30, this prevents the peripheral areas of the developing device 20 and the toner container 30 from being contaminated with the toner.

Structure of Contact Communication of Storage Unit

Figure 15:
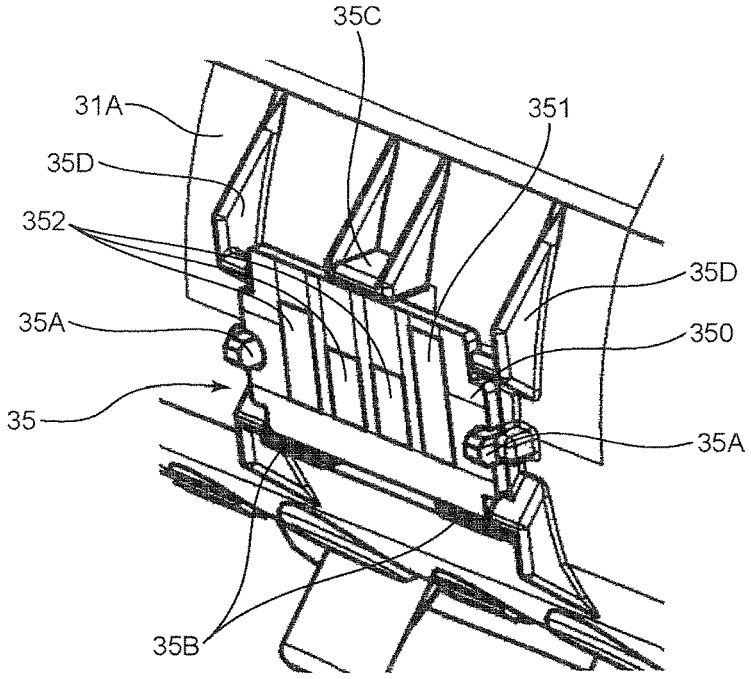
FIG. 15 illustrates a perspective view of an enlarged proximity of a storage unit of the toner container in the image forming apparatus.
Figure 16:
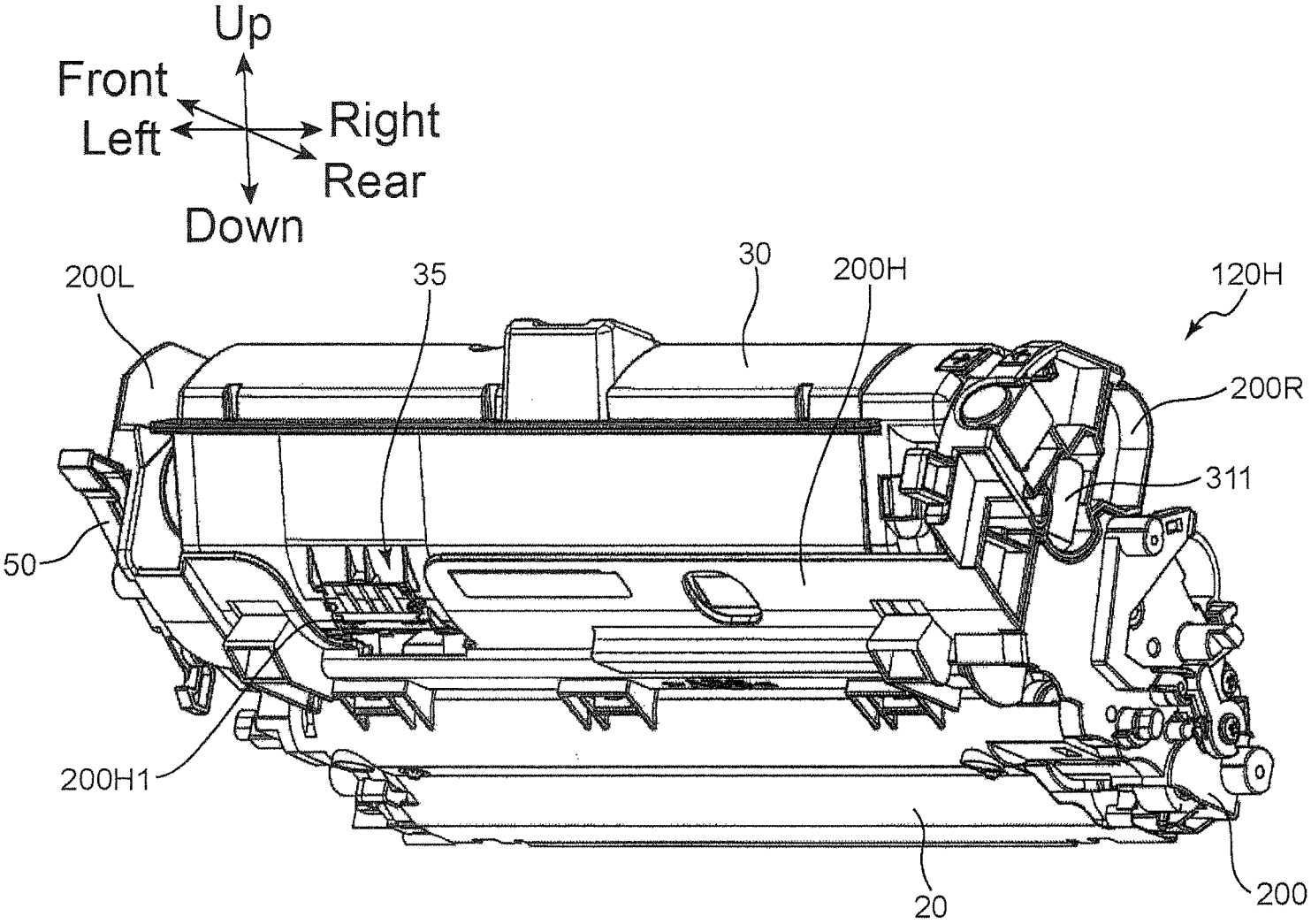
FIG. 16 illustrates a perspective view of the developer unit in the image forming apparatus.
Figure 17:
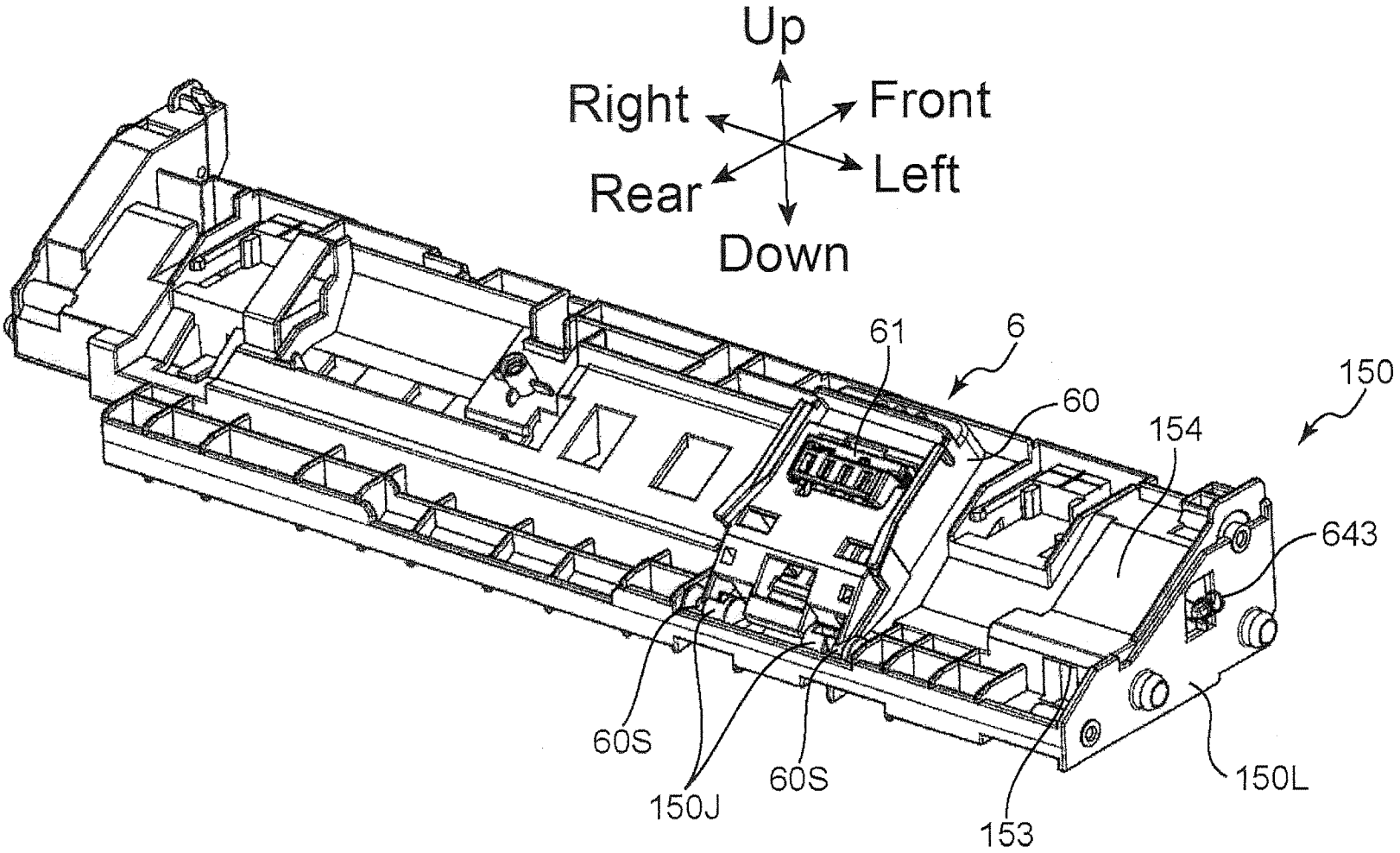
FIG. 17 illustrates a perspective view of the main body unit in the image forming apparatus.
Figure 18A:
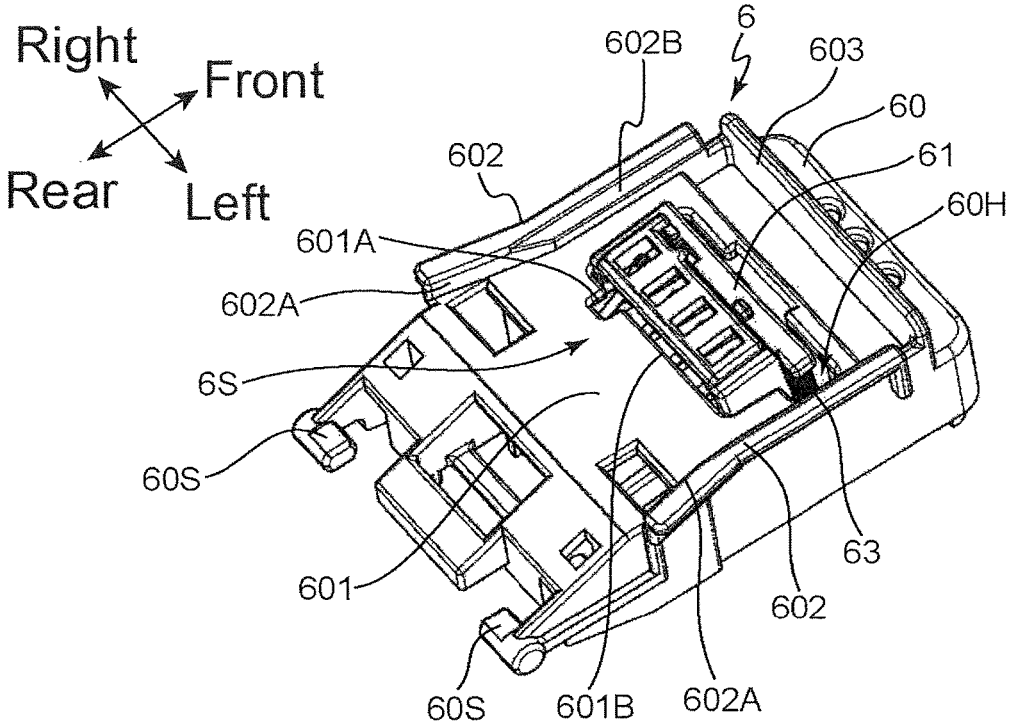
FIG. 18A illustrates a perspective view of a connector portion located on the main body unit.
Figure 18B:
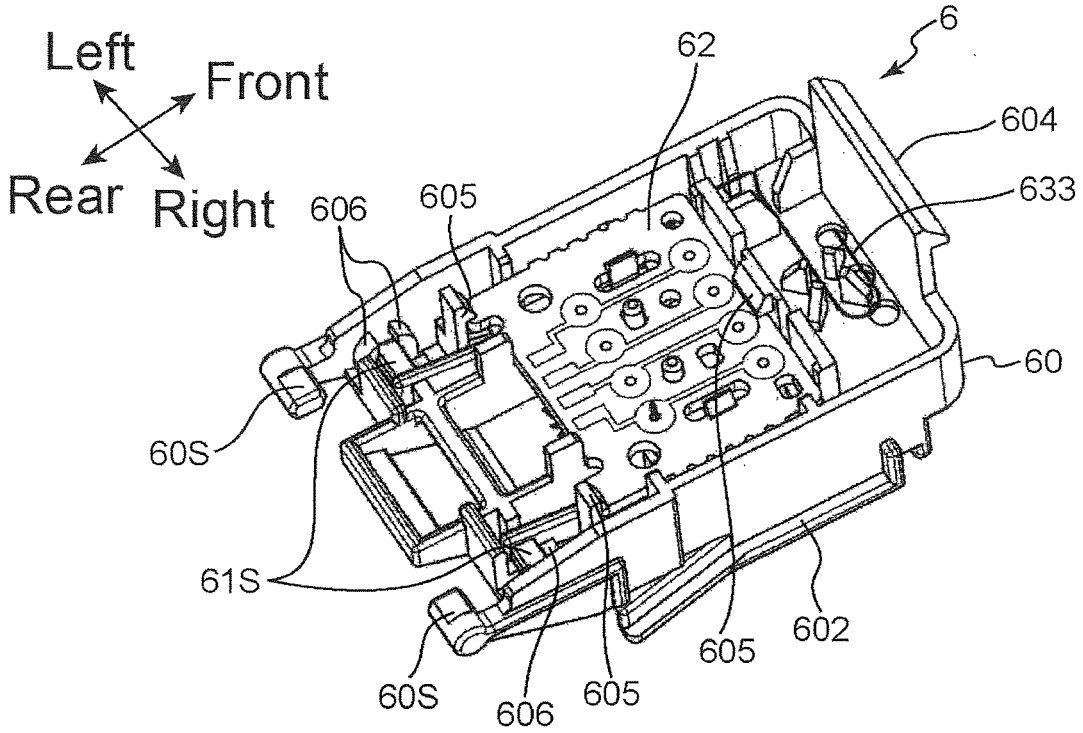
FIG. 18B illustrates a perspective view of the connector portion located on the main body unit.
Figure 19A:
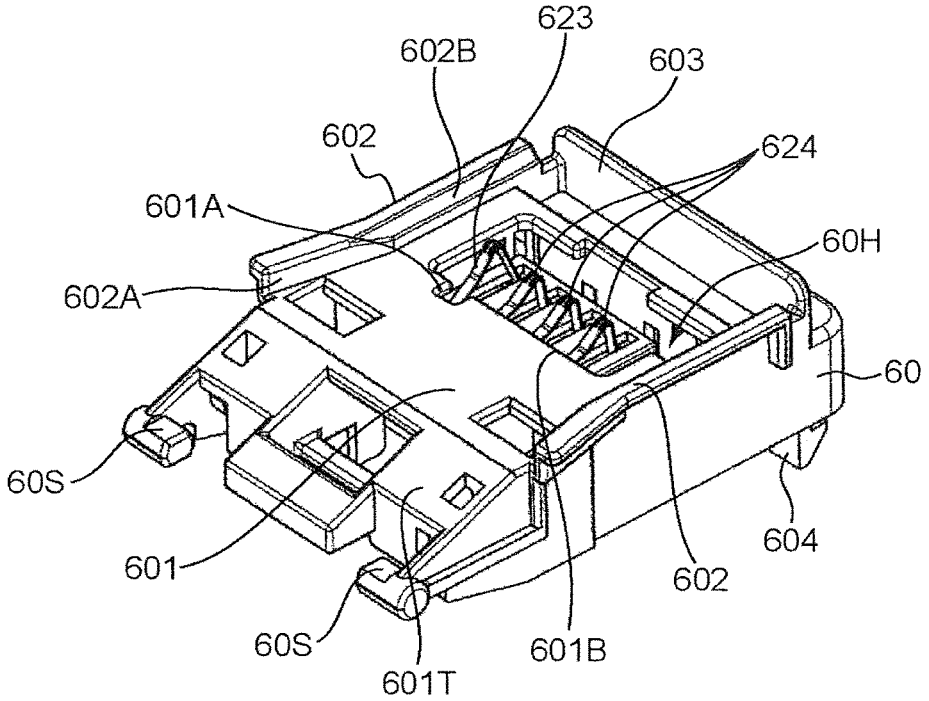
FIG. 19A illustrates a perspective view of the connector portion from which a connector shutter is removed.
Figure 19B:
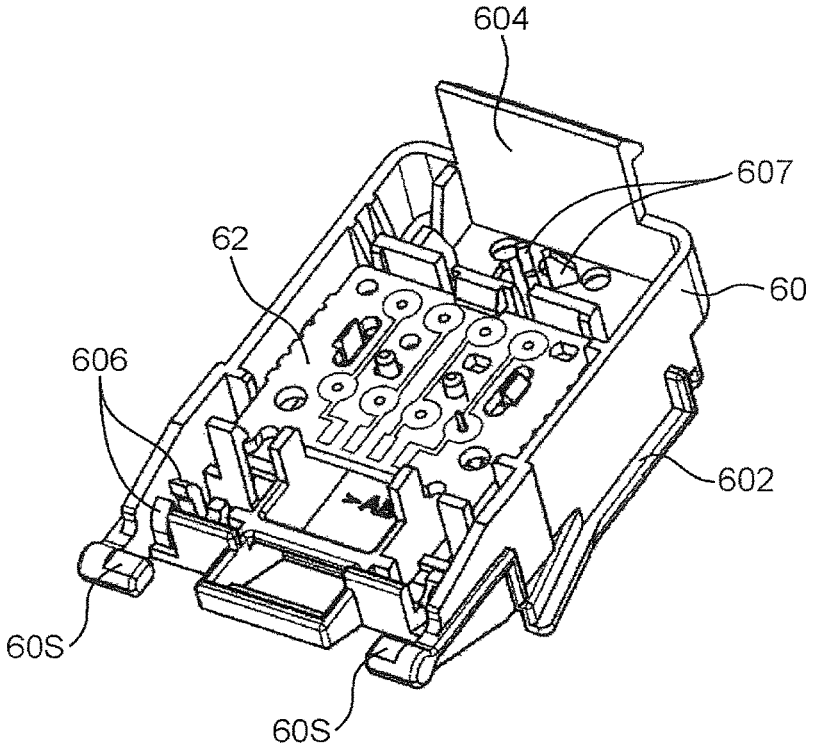
FIG. 19B illustrates a perspective view of the connector portion from which the connector shutter is removed.
Figure 20A:
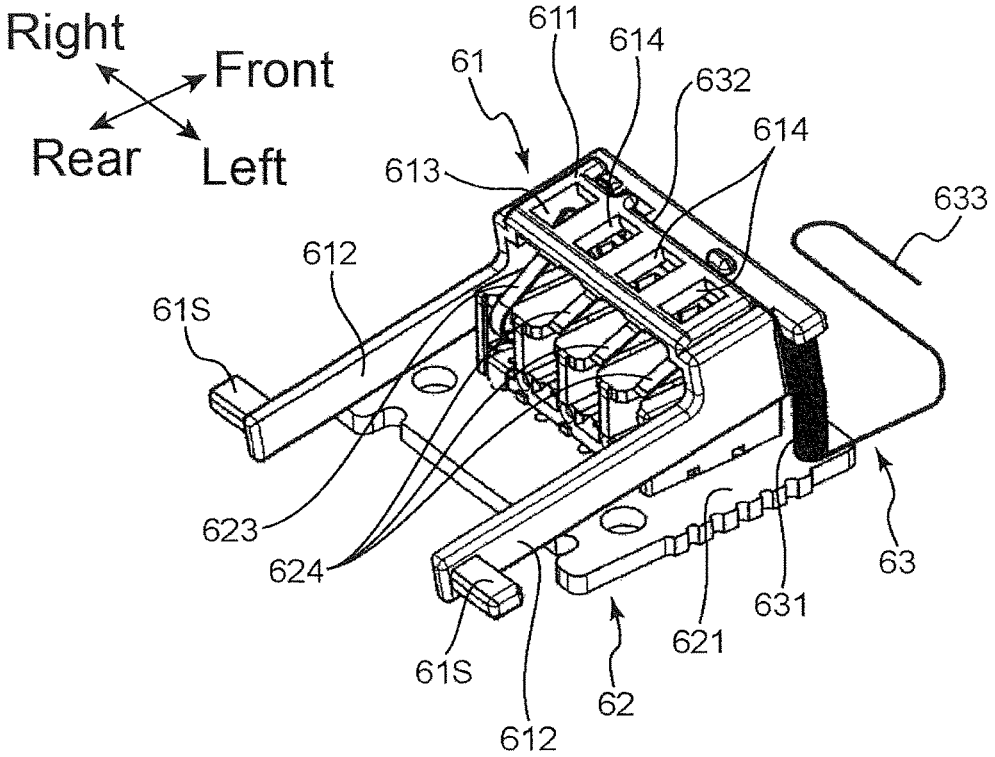
FIG. 20A illustrates a perspective view of the connector shutter and a terminal unit in the connector portion.
Figure 20B:
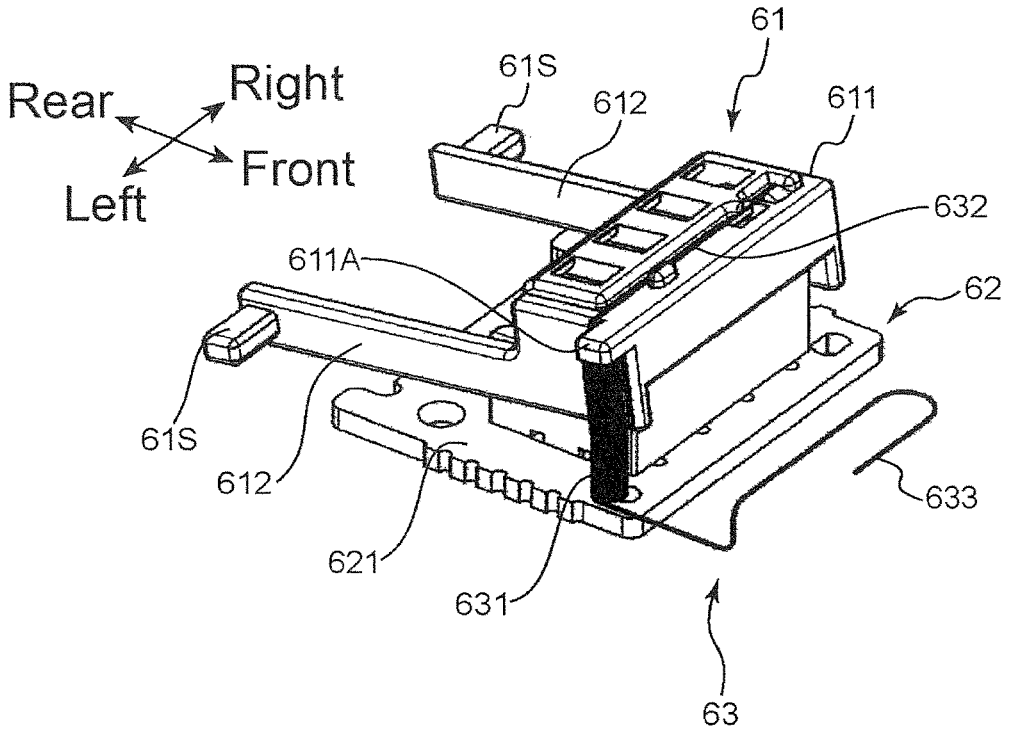
FIG. 20B illustrates a perspective view of the connector shutter and the terminal unit in the connector portion.
Figure 21A:
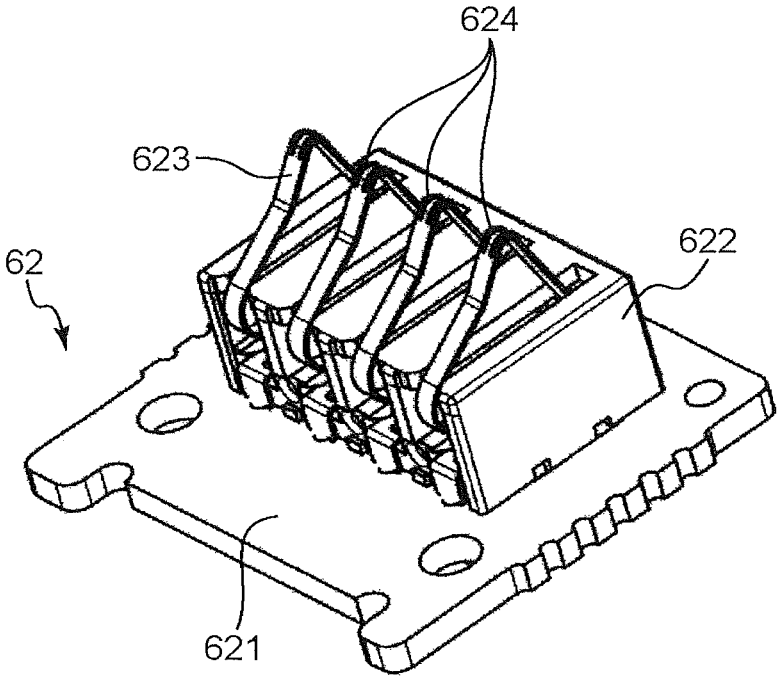
FIG. 21A illustrates a perspective view of the terminal unit of the connector portion.
Figure 21B:
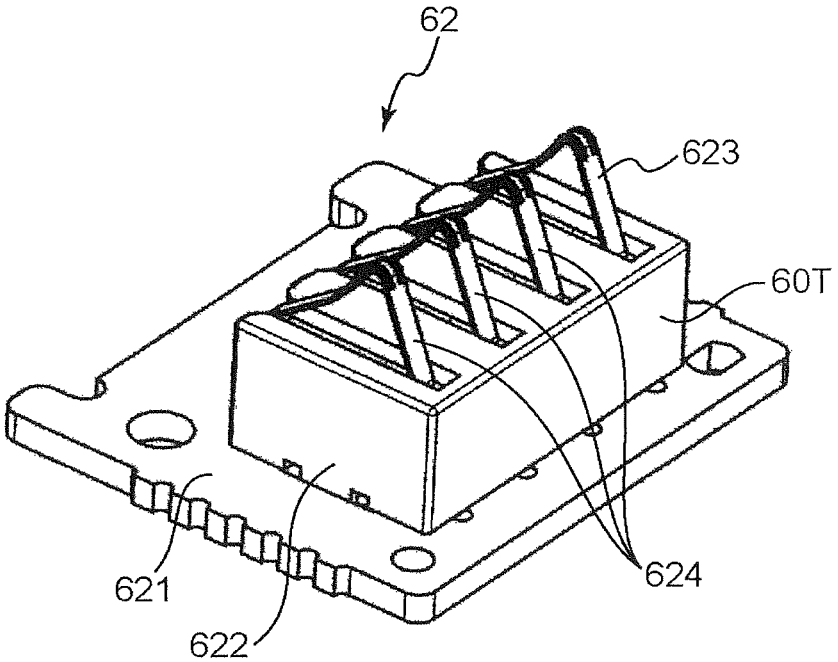
FIG. 21B illustrates a perspective view of the terminal unit of the connector portion.
Figure 22A:
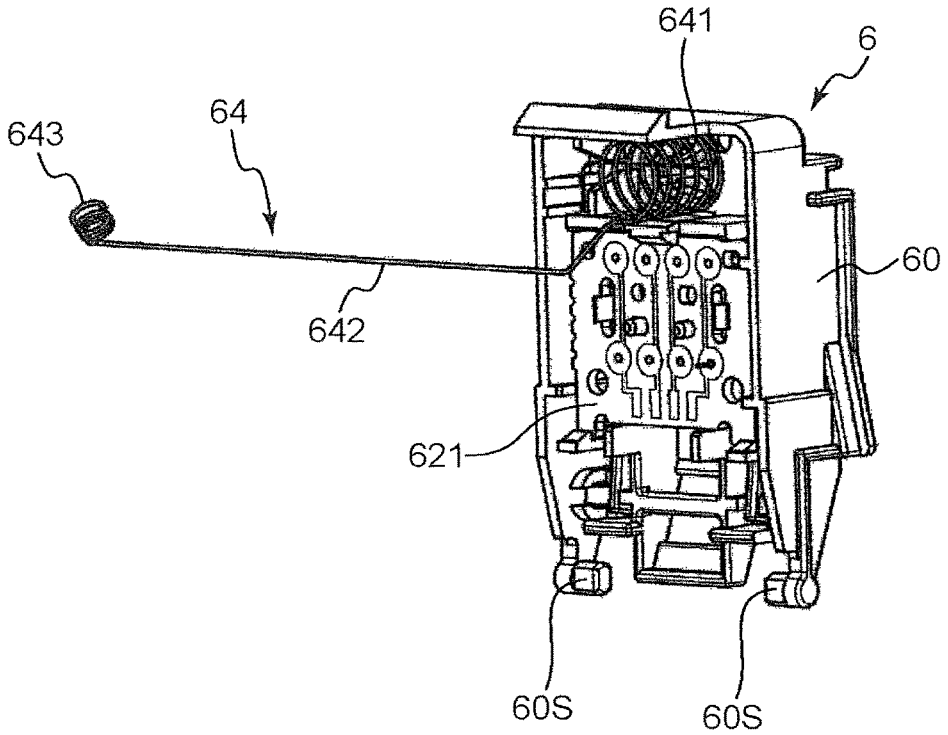
FIG. 22A illustrates a perspective view of the connector portion and a shutter urging spring.
Figure 22B:
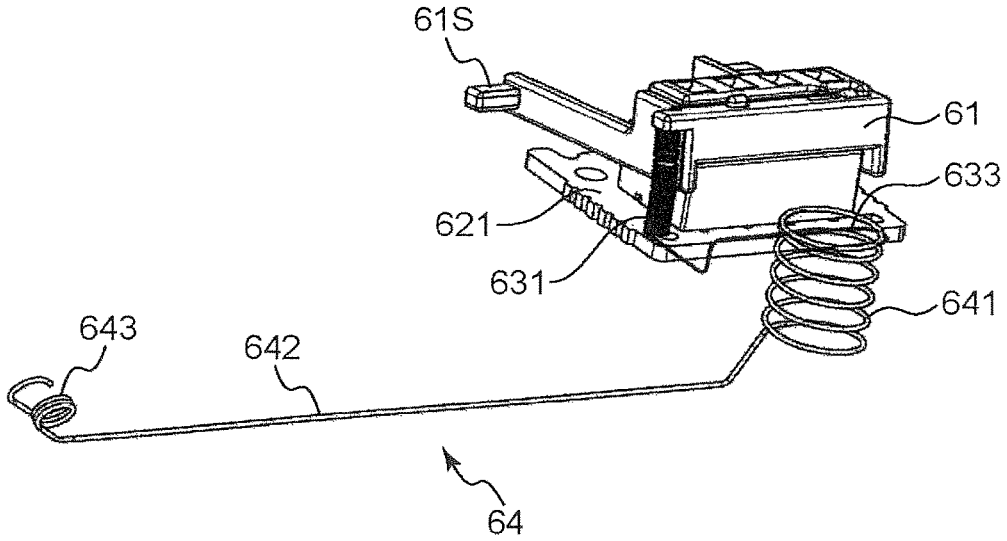
FIG. 22B illustrates a perspective view of a positional relation between the shutter urging spring and a housing urging spring in the connector portion.

The following describes a connector portion 6 of the main body unit 150 constituting a part of the housing 101 and a storage unit 35 of the toner container 30 according to the image forming apparatus 100. FIG. 15 illustrates a perspective view of an enlarged proximity of the storage unit 35 of the toner container 30. FIG. 16 illustrates a perspective view of the developer unit 120H. FIG. 17 illustrates a perspective view of the main body unit 150. FIGS. 18A and 18B illustrate perspective views of the connector portion 6 located on the main body unit 150. FIGS. 19A and 19B illustrate perspective views of the connector portion 6 from which a connector shutter 61 is removed. FIGS. 20A and 20B illustrate perspective views of the connector shutter 61 and a terminal unit 62 in the connector portion 6. FIGS. 21A and 21B illustrate a perspective view of the terminal unit 62 of the connector portion 6. FIG. 22A illustrates a perspective view of the connector portion 6 and a shutter urging spring 63. FIG. 22B illustrates a perspective view of a positional relation between the shutter urging spring 63 and a housing urging spring 64 in the connector portion 6.

Referring to FIGS. 4A and 15, the toner container 30 includes the storage unit 35. The storage unit 35 is mounted to an outer surface of the main unit 31A of the toner container 30. The storage unit 35 includes an IC chip 350, a ground terminal 351, and a plurality of input/output terminals 352 (second input/output terminals). The storage unit 35 includes engaging claws 35A, distal end regulating portions 35B, a rear end regulating portion 35C, and guide pieces 35D.

The IC chip 350 is a plate-shaped member having an approximately rectangular shape. The IC chip 350 stores predetermined information such as usage logs of the toner container 30 and information on the toner housed in the toner container 30. The ground terminal 351 is a ground line exposed outside the IC chip 350. Similarly, the input/output terminals 352 are terminals exposed outside the IC chip 350. The ground terminal 351 and the input/output terminals 352 of the storage unit 35 contact a ground terminal 623 and input/output terminals 624 (first input/output terminals), which will be described later, of the connector portion 6 respectively, so as to be electrically connected. The input/output terminals 352 of the storage unit 35 are electrically connected to the input/output terminals 624 of the connector portion 6 to transmit and receive various pieces of information stored in the IC chip 350.

In this embodiment, the ground terminal 351 and the input/output terminals 352 of the storage unit 35 are terminals having outermost surfaces on which gold plating layers are formed. More specifically, the ground terminal 351 and the input/output terminals 352 are terminals that have substrate metal plates containing, for example, Nickel, and gold plating layers are formed on the substrate metal plates. The ground terminal 351 and the input/output terminals 352 of the storage unit 35 are terminals that have predetermined lengths in the turning direction during the posture change of the toner container 30 mounted to the container mounting portion 20H of the developing device 20, and extend long in the turning direction.

The engaging claws 35A, the distal end regulating portions 35B, and the rear end regulating portion 35C are protrusions each protruded from the main unit 31A of the toner container 30 and have a function to secure the IC chip 350. The guide pieces 35D are projection pieces located upright from the main unit 31A so as to sandwich the IC chip 350. The guide pieces 35D extend along the turning direction of the toner container 30 during the posture change.

Referring to FIG. 16, the developer unit 120H has a container support plate 200H. The container support plate 200H is a support plate consecutively installed to the top panel of the development housing 200 to support the toner container 30 from the lower side. The container support plate 200H includes a cutout 200H1. The cutout 200H1 is formed by partially cutting out a part of the container support plate 200H. When the toner container 30 is mounted to the developing device 20, the cutout 200H1 exposes the IC chip 350 to the lower side of the developer unit 120H.

Referring to FIG. 17, the main body unit 150 constituting a part of the housing 101 includes the connector portion 6. The connector portion 6 is electrically connected to the IC chip 350 of the toner container 30, thus transmitting and receiving various pieces of information between the image forming apparatus 100 and the toner container 30.

The connector portion 6 is located at the main body unit 150 of the housing 101 opposed to the toner container 30. The connector portion 6 is swingably supported to the main body unit 150. With reference to FIGS. 17 to 22A, the connector portion 6 includes a connector housing 60, the connector shutter 61 (regulating member), the terminal unit 62, the shutter urging spring 63, and the housing urging spring 64.

The connector housing 60 is a housing part of the connector portion 6. The connector housing 60, which has an approximately rectangular parallelepiped shape, internally houses the connector shutter 61 and the terminal unit 62. The connector housing 60 includes housing shaft portions 60S, a support surface 601, guide sidewalls 602, a guide front wall 603, a housing lock claw 604, substrate engaging claws 605, shutter supporting portions 606, and spring lock portions 607.

The housing shaft portions 60S are pair of shaft portions located at a rear end portion of the connector housing 60. The housing shaft portions 60S are turnably supported to connector supporting portions 150J (see FIG. 17) on the main body unit 150. The housing shaft portions 60S are located on the connector housing 60 at an upstream in the turning direction (forward direction DM) of the toner container 30 when the posture of the toner container 30 is changed from the first posture to the second posture.

The support surface 601 corresponds to the top surface portion of the connector housing 60. In a state where the toner container 30 is mounted to the container mounting portion 20H of the developing device 20 in the second posture, the support surface 601 is located opposed to the storage unit 35 in the toner container 30. The support surface 601 has a housing opening 60H (see FIG. 18A). The rectangular-shaped housing opening 60H is open at an approximately center of the support surface 601. The housing opening 60H extends long in the lateral direction. A cutout end edge 601A and an opening rear end edge 601B define a rear side portion of the housing opening 60H. The cutout end edge 601A is formed by notching a part of the opening rear end edge 601B into a rectangular shape toward the rear. The cutout end edge 601A is opposed to a ground terminal 623 (see FIG. 19A), which will be described later. Between the support surface 601 and the housing shaft portions 60S, an inclined surface 601T (see FIG. 19A), which is inclined upward toward the support surface 601, is formed.

The guide sidewalls 602 are pair of walls located upright from right and left end portions of the support surface 601 so as to sandwich the housing opening 60H. The guide sidewalls 602 are formed extending long in the front-rear direction. The guide sidewall 602 includes first guide portions 602A and second guide portions 602B. The first guide portion 602A is a region of bent rear end portion of the guide sidewall 602. The pair of first guide portions 602A expand toward the front as approaching the housing shaft portions 60S in a direction along the support surface 601 (see FIG. 18A). The second guide portion 602B is formed on the front end side of the guide sidewall 602. The second guide portion 602B is a tapered surface formed on the upper end portion of the guide sidewall 602. The pair of second guide portions 602B expand toward the front as away from the support surface 601 in a direction perpendicular to the support surface 601. In FIG. 18A, only the right second guide portion 602B appears.

The guide front wall 603 is a wall portion located upright from the front end portion of the support surface 601. The guide front wall 603 is formed extending in the lateral direction. The guide front wall 603 and the pair of guide sidewalls 602 form a chip housing portion 6S (see FIG. 18A), which is formed of a flat-shaped space open at the rear portion. This chip housing portion 6S can house the IC chip 350 on the storage unit 35 of the toner container 30.

The housing lock claw 604 is a craw projected from the front side wall portion of the connector housing 60 toward approximately downward. The housing lock claw 604 is lockable to a locked portion 155A (see FIG. 24A) of the main body unit 150. The substrate engaging claws 605 (see FIG. 18B) are three craws projected from a back side of the support surface 601. The substrate engaging claws 605 secure the terminal unit 62 to the connector housing 60. The shutter supporting portions 606 are pair of bearing portions formed at the front of the pair of housing shaft portions 60S on the back side of the support surface 601. The shutter supporting portions 606 turnably support shutter shaft portions 61S on the connector shutter 61, which will be described later. The spring lock portions 607 are protrusions at the rear of the housing lock claw 604 projected from the back side of the support surface 601. The spring lock portions 607 are four protrusions located in a cross shape. One end of the housing urging spring 64 is locked to the spring lock portions 607 (see FIG. 18B).

The connector shutter 61 (see FIG. 20A) is located inside the connector housing 60. The connector shutter 61 is partially projected from the housing opening 60H on the connector housing 60. The connector shutter 61 has a function to protect the ground terminal 623 and input/output terminals 624 of the terminal unit 62. Further, the connector shutter 61 has a function as a regulating member that permits the contact of the ground terminal 623 and the input/output terminals 624 in the terminal unit 62 with the ground terminal 351 and the input/output terminals 352 in the storage unit 35 when the toner container 30 mounted to the container mounting portion 20H of the developing device 20 is in the second posture, and regulates the contact of the ground terminal 623 and the input/output terminals 624 with the ground terminal 351 and the input/output terminals 352 when the toner container 30 is in the first posture.

The connector shutter 61 includes a cover 611, legs 612, a first opening 613, second openings 614, and the shutter shaft portions 61S.

The cover 611 is a main part of the connector shutter 61 and has an approximately U-shape in front view. The cover 611 covers the housing opening 60H. On the top surface portion of the cover 611, the first opening 613 and the second openings 614 are open. The first opening 613 is an opening open to a right edge portion on the top surface portion of the cover 611. The three second openings 614 are open spaced on the left side of the first opening 613. The first opening 613 exposes the ground terminal 623 (see FIG. 19A), which projects from the housing opening 60H. The second openings 614 each expose the input/output terminals 624 (see FIG. 19A), which project from the housing opening 60H. Regions around the first opening 613 and the second openings 614 on the cover 611 protect the ground terminal 623 and the input/output terminals 624.

The pair of legs 612 extend from right and left end portions of the cover 611 toward the rear. The respective shutter shaft portions 61S are located on rear end portions of the pair of legs 612. The shutter shaft portions 61S serve as fulcrums in the swing of the connector shutter 61. The shutter supporting portions 606 (see FIG. 18B) of the connector housing 60 turnably support the shutter shaft portions 61S. The shutter shaft portions 61S are located at upstream in the turning direction (forward direction DM) of the toner container 30 when the posture of the toner container 30 is changed from the first posture to the second posture on the connector shutter 61.

The connector shutter 61 further includes an earth 632 (see FIG. 20B). The earth 632 is adjacent to the first opening 613 and the second openings 614 on the front side. The earth 632 is an electric wire that runs so as to extend in the lateral direction at the upper end portion of the cover 611. When the user of the image forming apparatus 100 attempts to touch the connector portion 6 or in a similar case, the earth 632 prevents a discharge and a leakage at the connector portion 6. Starting the use of the image forming apparatus 100 grounds the earth 632. In this embodiment, the earth 632 is constituted of a part of the shutter urging spring 63.

The terminal unit 62 (see FIGS. 21A and 21B) is located inside the connector housing 60. As illustrated in FIGS. 20A and 20B, the terminal unit 62 is located below the cover 611 of the connector shutter 61. The terminal unit 62 includes a substrate 621, a support box 622, the ground terminal 623, and the input/output terminals 624 (first input/output terminals).

The substrate 621 is located at a lower part of the terminal unit 62. The substrate 621 has an approximately rectangular shape. The substrate 621 is electrically connected to a control unit (not illustrated) in the housing 101 by a harness (not illustrated). The support box 622 has a box shape connected to the substrate 621. The support box 622 has a function to support the ground terminal 623 and the input/output terminals 624. The wall portion on the front side of the support box 622 functions as a support wall 60T, which will be described later.

As illustrated in FIGS. 21A and 21B, the ground terminal 623 and the three input/output terminals 624 are terminals protruded from respective grooves formed on the support box 622. The ground terminal 623 and the input/output terminals 624 are formed of bent metal wires having an approximately triangular shape in side view. The ground terminal 623 and the input/output terminals 624 are electrically connected to respective terminals (not illustrated) of the substrate 621. The ground terminal 623 and the input/output terminals 624 project from the housing opening 60H upward with leaf spring like elastic force (see FIG. 19A). The ground terminal 623 and the input/output terminals 624 contact the ground terminal 351 and the input/output terminals 352 in the storage unit 35 respectively, so as to be electrically connected. The ground terminal 623 and the input/output terminals 624 are pressed by the ground terminal 351 and the input/output terminals 352 from upward, so as to be elastically deformable downward.

The shutter urging spring 63 (see FIGS. 20A and 20B) urges the connector shutter 61 around the shutter shaft portions 61S such that the cover 611 of the connector shutter 61 projects from the housing opening 60H (see FIG. 18A). The shutter urging spring 63 includes a first coil 631, the above-described earth 632, and a conductive portion 633. The first coil 631, the earth 632, and the conductive portion 633 are constituted of one metal wire. The first coil 631 is a coil spring part compressed between a protrusion 611A (see FIG. 20B), which is formed on the left end portion of the cover 611, and the substrate 621. The earth 632 extends from the upper end portion of the first coil 631 and is locked to the right edge portion of the cover 611. As described above, the earth 632 prevents a leakage or similar failure at the ground terminal 623 and the input/output terminals 624. The conductive portion 633 is a region that extends from the lower end portion of the first coil 631 and is bent into an approximately U shape in front of the connector shutter 61 and the terminal unit 62. As illustrated in FIG. 18B, the conductive portion 633 is locked to the spring lock portions 607 (see FIG. 19B).

The housing urging spring 64 (see FIGS. 22A and 22B) is compressibly deformable between the connector housing 60 and the main body unit 150. The housing urging spring 64 urges the connector housing 60 around the housing shaft portions 60S in a direction that the ground terminal 623 and the input/output terminals 624 approach the ground terminal 351 and the input/output terminals 352. The housing urging spring 64 includes a second coil 641, a wire 642, and a frame conductive portion 643. The second coil 641 is a coil spring part compressed and deformed between the connector housing 60 and the main body unit 150. The upper end portion of the second coil 641 is locked to the spring lock portions 607 in the connector housing 60. The lower end portion of the second coil 641 is locked to a spring supporting portion 155B (see FIG. 24A), which is included in the main body unit 150. The wire 642 is a linear part extending from the lower end portion of the second coil 641. The wire 642 is run inside the main body unit 150 to the left side. The frame conductive portion 643 is constituted of a coiled part and a hook formed on the distal end portion of the wire 642. The frame conductive portion 643 is locked to the proximity of an opening open on a unit left wall 150L of the main body unit 150. When the main body unit 150 to which the connector portion 6 is preliminary mounted is mounted to the inside of the housing 101, the frame conductive portion 643 projecting from the unit left wall 150L contacts a metal frame (not illustrated) of the housing 101. Consequently, the housing urging spring 64 is grounded.

The connector portion 6 is mounted to the main body unit 150 through the following assembly procedure of the connector portion 6. First, with a posture of the connector shutter 61 such that the support surface 601 (see FIG. 18A) of the connector housing 60 is perpendicular to the legs 612 (see FIG. 20A) of the connector shutter 61, the pair of shutter shaft portions 61S are inserted into a pair of shutter supporting portions 606 of the connector housing 60. Rotationally driving the connector shutter 61 around the shutter shaft portions 61S forward by approximately 90 degrees, the connector shutter 61 is housed inside the connector housing 60. Then, the conductive portion 633 of the shutter urging spring 63 preliminary mounted to the connector shutter 61 is locked to the spring lock portions 607 on the front end side of the connector housing 60 (see FIG. 18B).

Further, the terminal unit 62 (see FIG. 21A) is mounted to the inside of the connector housing 60 (see FIG. 18B) so as to compress the first coil 631 with the connector shutter 61. The three substrate engaging claws 60S lock the substrate 621 of the terminal unit 62. With the second coil 641 secured to the spring supporting portion 155B of the main body unit 150, the housing shaft portions 60S of the connector housing 60 are journaled to the connector supporting portions 150J (see FIG. 17). While the spring lock portions 607 on the connector housing 60 compress the upper end portion of the second coil 641, the housing lock claw 604 is locked to the locked portion 155A (see FIG. 24A). When the second coil 641 of the housing urging spring 64 contacts the conductive portion 633 of the shutter urging spring 63 inside the connector housing 60 (see FIG. 22B), the shutter urging spring 63 and the housing urging spring 64 become electrically conductive. Consequently, the earth 632 of the shutter urging spring 63 is grounded via the above-described metal frame of the housing 101.

Positional Relation Between Storage Unit and Connector Portion by Posture Change of Toner Container Next, a description will be given of a positional relation between the storage unit 35 and the connector portion 6 by the posture change of the toner container 30 mounted to the container mounting portion 20H of the developing device 20.

First Embodiment

Figure 23:
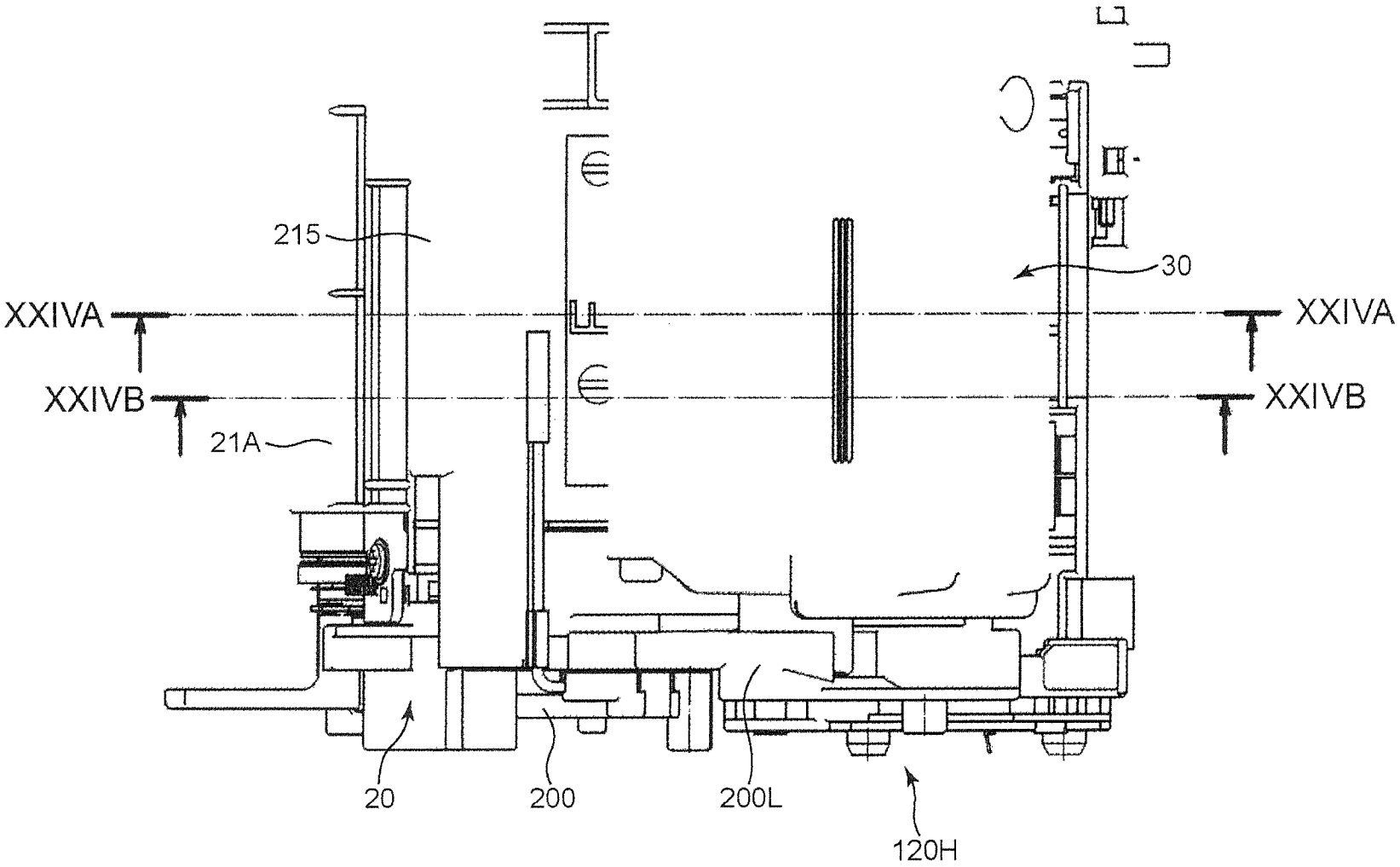
FIG. 23 illustrates a top view of a positional relation between the storage unit and the connector portion in a state where the toner container is mounted to the developing device in the first posture in the image forming apparatus according to a first embodiment.
Figure 24A:
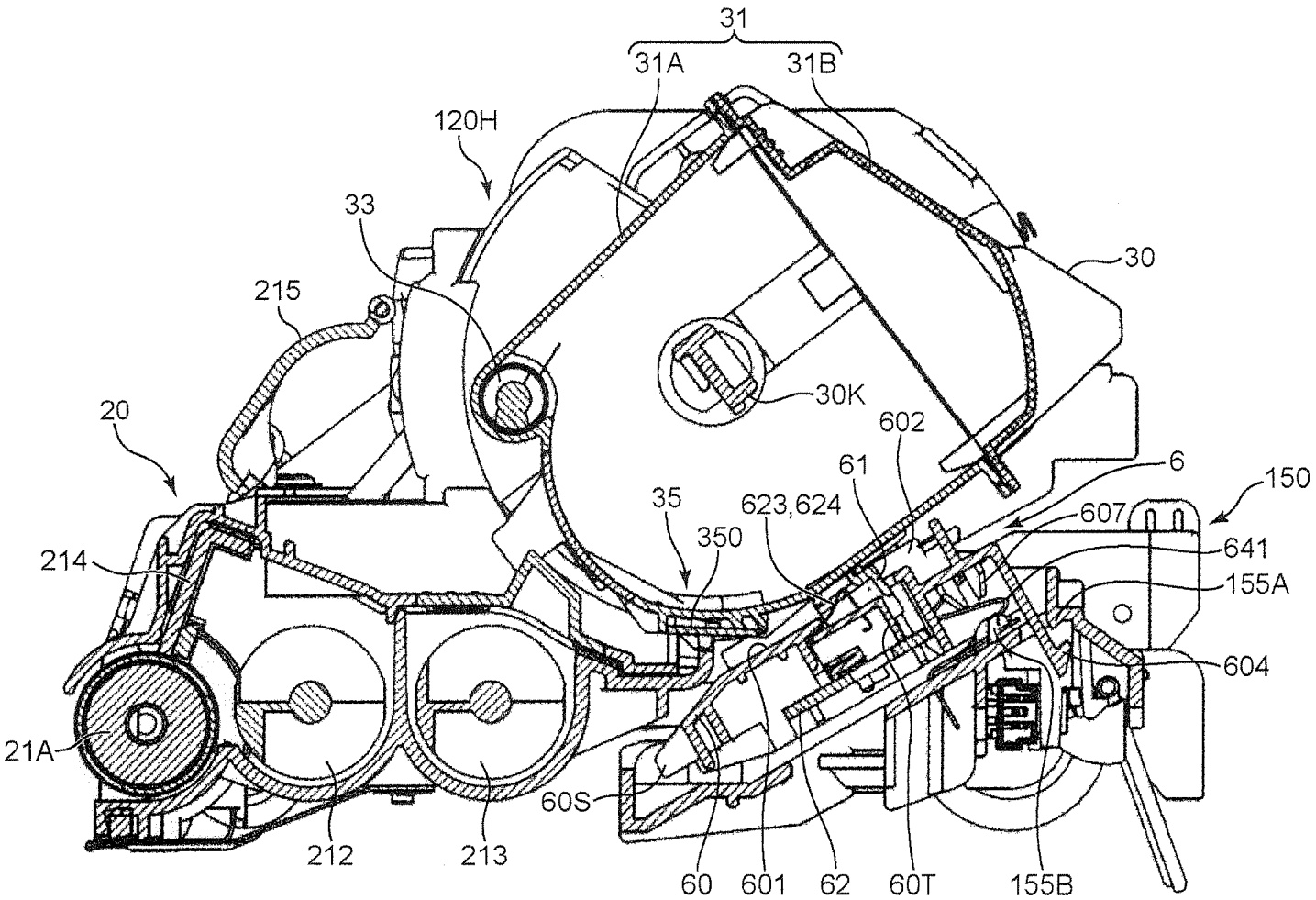
FIG. 24A illustrates a cross-sectional view taken along line XXIVA-XXIVA in FIG. 23.
Figure 24B:
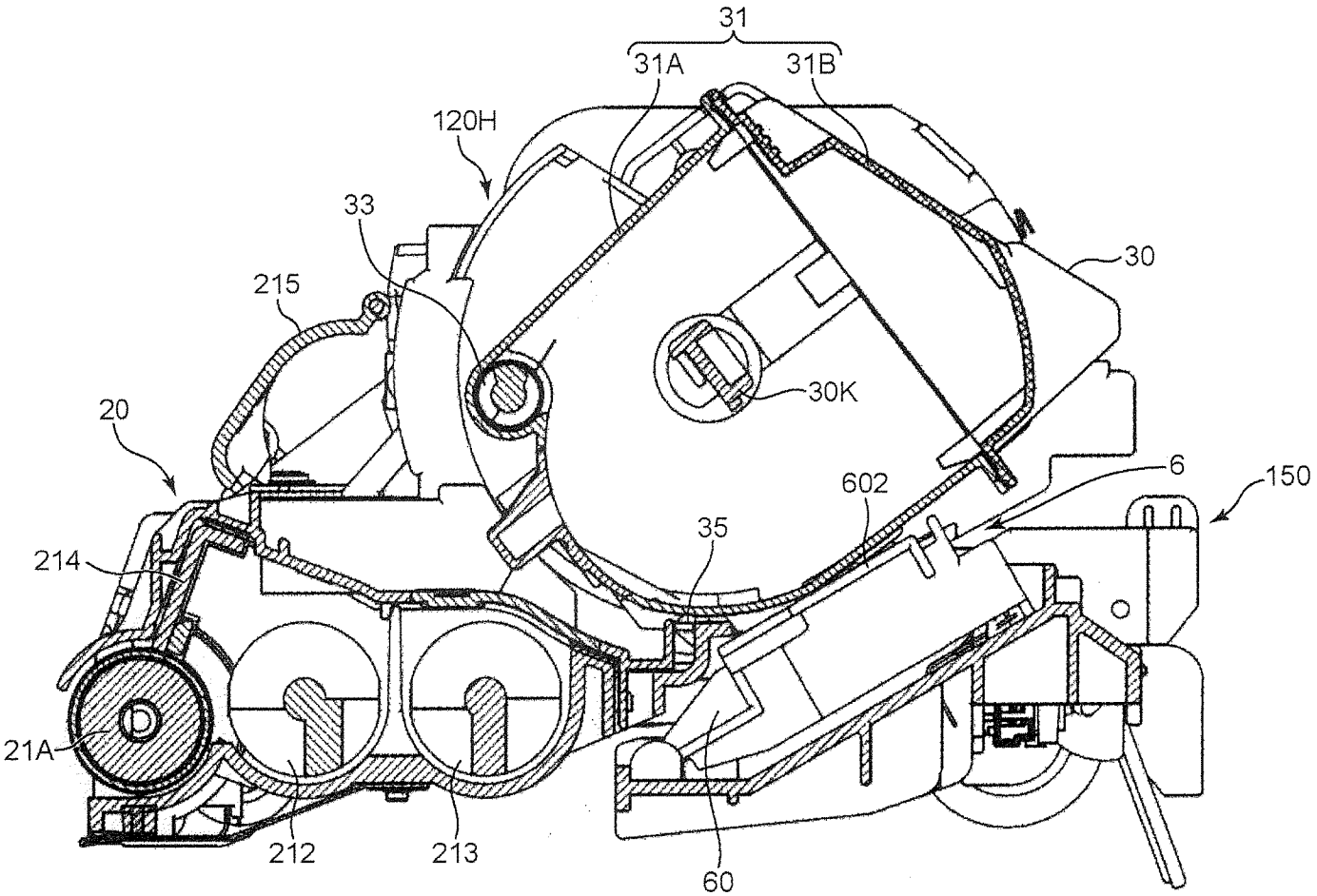
FIG. 24B illustrates a cross-sectional view taken along line XXIVB-XXIVB in FIG. 23.
Figure 25:
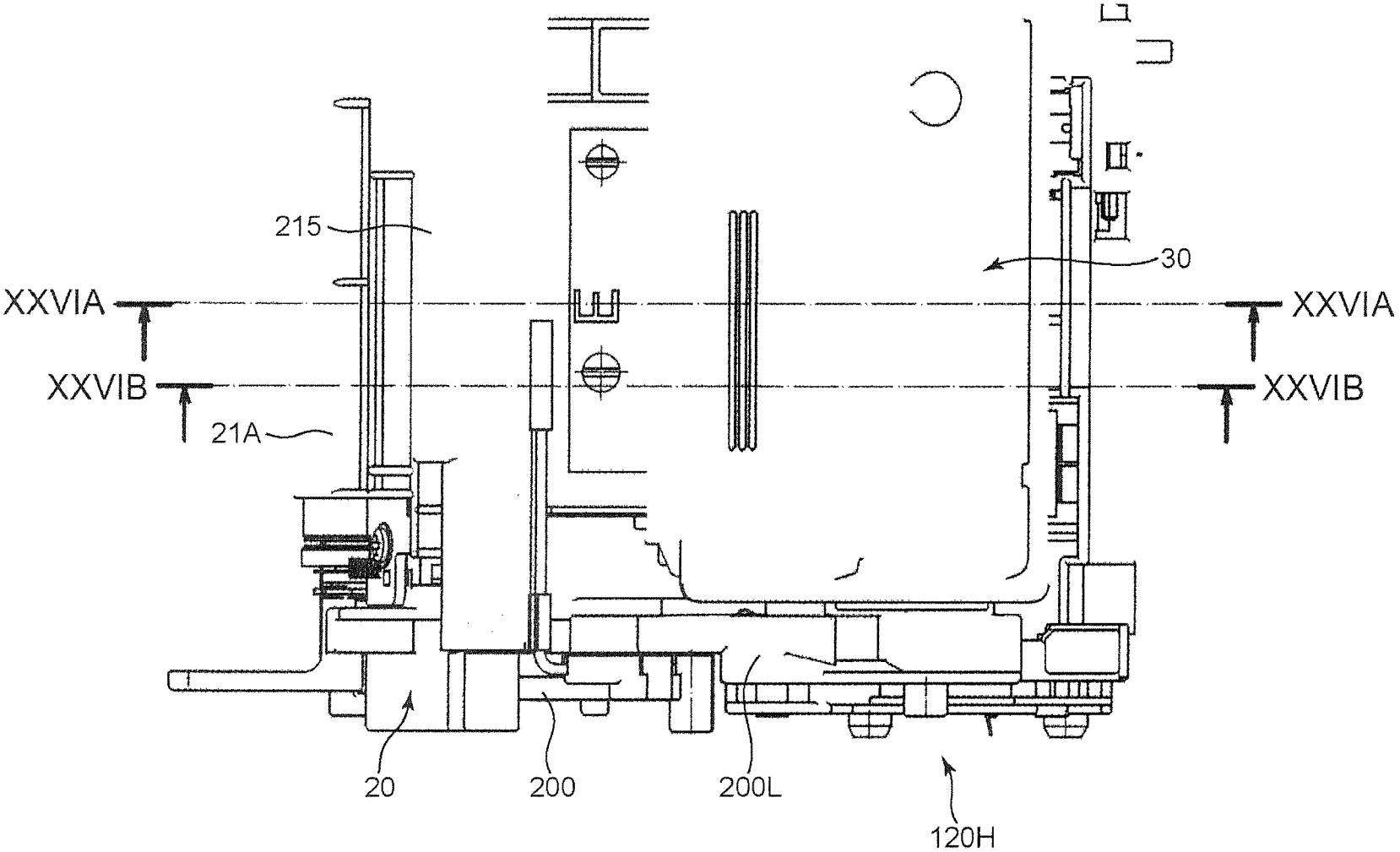
FIG. 25 illustrates a top view of a positional relation between the storage unit and the connector portion in a state where the toner container is mounted to the developing device in the second posture in the image forming apparatus according to the first embodiment.
Figure 26A:
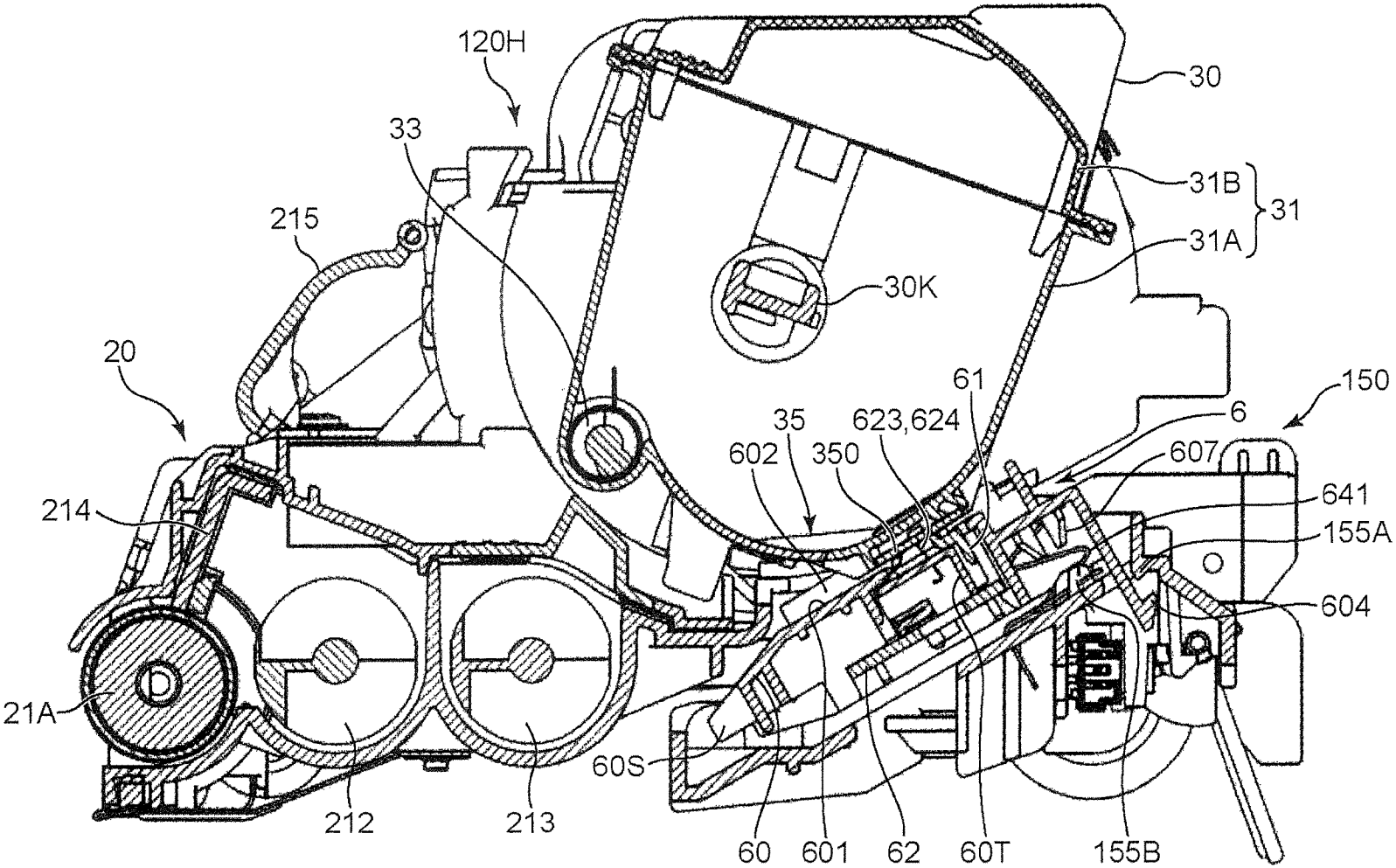
FIG. 26A illustrates a cross-sectional view taken along line XXVIA-XXVIA in FIG. 25.
Figure 26B:
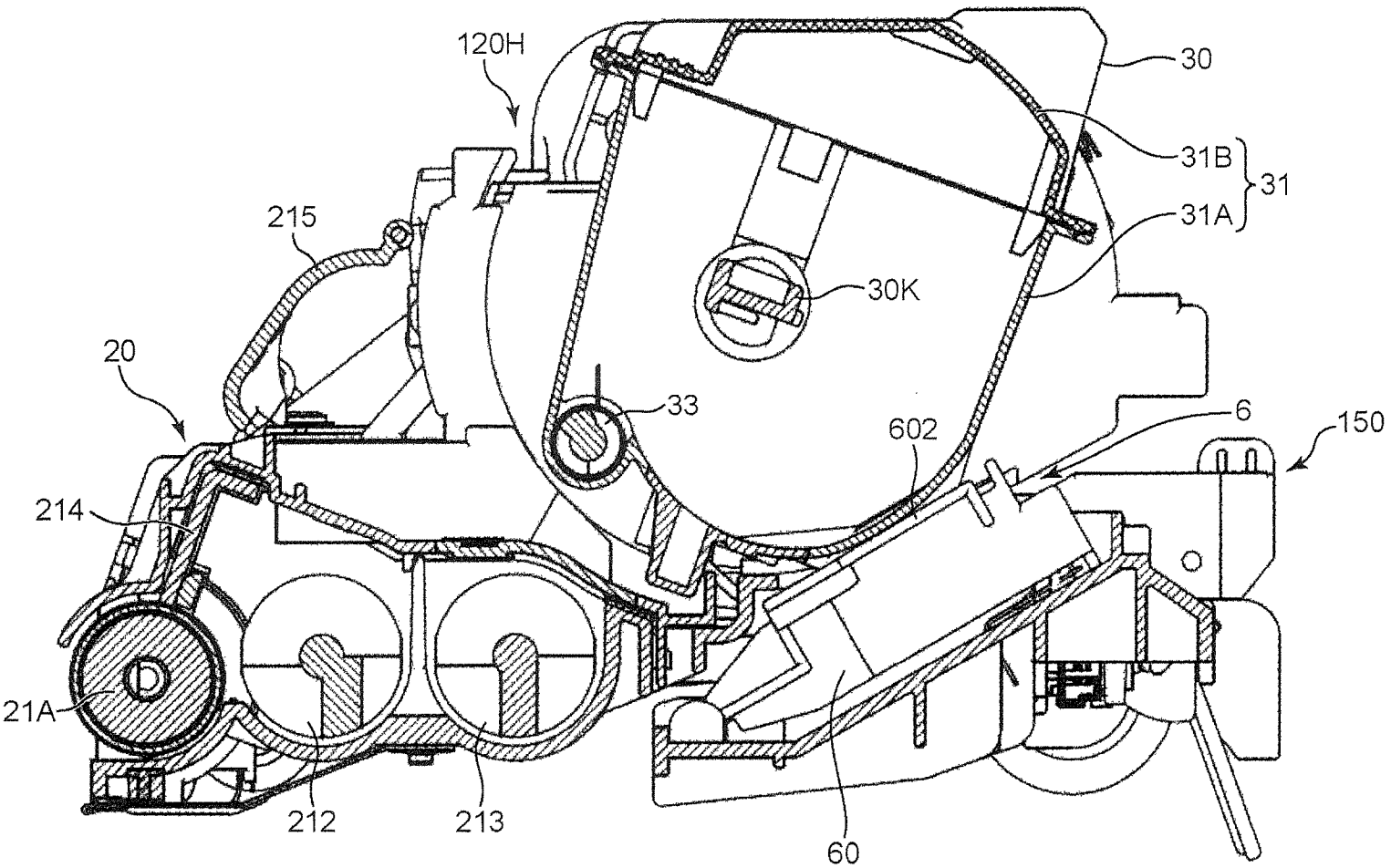
FIG. 26B illustrates a cross-sectional view taken along line XXVIB-XXVIB in FIG. 25.

FIGS. 23, 24A, and 24B illustrate the positional relation between the storage unit 35 and the connector portion 6 in a state where the toner container 30 is mounted to the developing device 20 in the first posture in the image forming apparatus 100 according to the first embodiment. FIG. 23 illustrates a top view, FIG. 24A illustrates a cross-sectional view taken along line XXIVA-XXIVA in FIG. 23, and FIG. 24B illustrates a cross-sectional view taken along line XXIVB-XXIVB in FIG. 23. FIGS. 25, 26A, and 26B illustrate the positional relation between the storage unit 35 and the connector portion 6 in a state where the toner container 30 is mounted to the developing device 20 in the second posture in the image forming apparatus 100 according to the first embodiment. FIG. 25 illustrates a top view, FIG. 26A illustrates a cross-sectional view taken along line XXVIA-XXVIA in FIG. 25, and FIG. 26B illustrates a cross-sectional view taken along line XXVIB-XXVIB in FIG. 25.

In the image forming apparatus 100 according to the first embodiment, as described above, the posture of the toner container 30 is changeable between the first posture where the toner discharge port 30P does not communicate with the toner replenishment port 204 of the developing device 20 and the second posture where the toner discharge port 30P communicates with the toner replenishment port 204 in a state where the toner container 30 is mounted to the container mounting portion 20H of the developing device 20.

Here, focusing on the positional relation between the storage unit 35 mounted on an outer surface of the main unit 31A of the toner container 30 and the connector portion 6 located on the main body unit 150 constituting a part of the housing 101, in a state where the toner container 30 is mounted to the developing device 20 in the first posture, as illustrated in FIG. 24A, the IC chip 350 of the storage unit 35 is located to be separated from the ground terminal 623 and the input/output terminals 624 of the connector portion 6. That is, in a state where the toner container 30 is mounted to the developing device 20 in the first posture, the ground terminal 351 and the input/output terminals 352 of the storage unit 35 are located to be separated from the ground terminal 623 and the input/output terminals 624 of the connector portion 6.

On the other hand, in a state where the toner container 30 is mounted to the developing device 20 in the second posture, as illustrated in FIG. 26A, the IC chip 350 of the storage unit 35 is located to be in contact with the ground terminal 623 and the input/output terminals 624 of the connector portion 6. That is, in a state where the toner container 30 is mounted to the developing device 20 in the second posture, the ground terminal 351 and the input/output terminals 352 of the storage unit 35 contact the ground terminal 623 and the input/output terminals 624 of the connector portion 6 so as to be electrically connectable.

In the image forming apparatus 100 according to the first embodiment, packing the image forming apparatus 100 in a state where the toner container 30 is mounted to the developing device 20 in the first posture (posture in FIG. 24A) ensures the toner container 30 to be packed together in a state where the ground terminal 351 and the input/output terminals 352 of the storage unit 35 are separated from the ground terminal 623 and the input/output terminals 624 of the connector portion 6. Transporting the image forming apparatus 100 in such state prevents abrasion of the ground terminal 351 and the input/output terminals 352 of the storage unit 35 caused by vibrations during the transportation and similar factor. Accordingly, when the image forming apparatus 100 is installed in a predetermined installation environment after the transportation, the posture of the toner container 30 is changed from the first posture to the second posture (posture in FIG. 26A), and the ground terminal 351 and the input/output terminals 352 of the storage unit 35 contact the ground terminal 623 and the input/output terminals 624 of the connector portion 6, the stability of the contact communication of the storage unit 35 is ensured without conduction failures.

In a state where the toner container 30 is mounted to the developing device 20 in the first posture, the toner discharge port 30P does not communicate with the toner replenishment port 204 of the developing device 20. Then, transporting the image forming apparatus 100 in such state prevents the toner from flowing into the developing device 20 from the toner container 30 in a large amount due to vibrations during the transportation and similar factor. This prevents the inside of the image forming apparatus 100 from being stained by the toner.

As described above, in a state where the toner container 30 is mounted to the container mounting portion 20H of the developing device 20, the toner container 30 is turnable around the axis center of the container paddle 30K in both forward and reverse directions. Turning the toner container 30 from the first posture in the forward direction DM changes the posture to the second posture, and turning from the second posture in the reverse direction DN changes the posture to the first posture. Such simple operation as turning the toner container 30 can change the posture of the toner container 30 between the first posture and the second posture. Therefore, the simple operation ensures the stability of the contact communication of the storage unit 35 without the conduction failures between the storage unit 35 and the connector portion 6.

The following describes the turning operation during the posture change of the toner container 30 more specifically.

When the toner container 30 is not mounted to the container mounting portion 20H of the developing device 20, the connector housing 60 of the connector portion 6 is urged upward around the housing shaft portions 60S by the second coil 641. The connector shutter 61 of the connector portion 6 is urged upward around the shutter shaft portions 61S by an urging force from the first coil 631. In the connector portion 6, the ground terminal 623 and the input/output terminals 624 projecting from the housing opening 60H of the connector housing 60 are sunk inside the first opening 613 and the second openings 614 of the connector shutter 61, respectively. Then, in the connector portion 6, the ground terminal 623 and the input/output terminals 624 are protected by the connector shutter 61.

When the toner container 30 is mounted to the container mounting portion 20H of the developing device 20 to have the first posture, as described above, the IC chip 350 of the storage unit 35 is located to be separated from the ground terminal 623 and the input/output terminals 624 of the connector portion 6. In a state where the toner container 30 is mounted to the developing device 20 in the first posture, as illustrated in FIG. 24B, the guide sidewalls 602 of the connector housing 60 in the connector portion 6 are brought in contact with the main unit 31A of the toner container 30. Therefore, as illustrated in FIG. 24A, the connector housing 60 moves down around the housing shaft portions 60S against the urging force of the second coil 641. When the connector housing 60 moves down around the housing shaft portions 60S, the housing lock claw 604 separates downward from the locked portion 155A. At this time, the connector shutter 61 receives no force acting against the urging force of the first coil 631. Then, in a state where the toner container 30 is mounted to the developing device 20 in the first posture, the connector shutter 61 regulates the contact of the ground terminal 623 and the input/output terminals 624 in the connector portion 6 with the main unit 31A of the toner container 30. Consequently, during the transportation of the image forming apparatus 100 in a state where the toner container 30 is mounted to the developing device 20 in the first posture, the ground terminal 623 and the input/output terminals 624 in the connector portion 6 are held to be protected by the connector shutter 61.

On the other hand, when the toner container 30 mounted to the developing device 20 is turned in the forward direction DM for changing the posture from the first posture to the second posture, while the guide pieces 35D (see FIG. 15) in the storage unit 35 are guided by the inclined surface 601T (see FIG. 19A) and the first guide portions 602A (see FIG. 19A) in the connector portion 6, the guide pieces 35D press the support surface 601 (see FIGS. 19A and 26A), thus the connector housing 60 moves down around the housing shaft portions 60S against the urging force from the second coil 641.

The IC chip 350 in the storage unit 35 presses the connector shutter 61 downward while abutting on the connector shutter 61 along the support surface 601 in the connector portion 6. This moves down the connector shutter 61 around the shutter shaft portions 61S against the urging force from the first coil 631. Then, when, as illustrated in FIG. 26A, the toner container 30 comes in the second posture such that the IC chip 350 in the storage unit 35 is located opposed to the support surface 601 in the connector portion 6 and the connector shutter 61 is sandwiched between the IC chip 350 and the support wall 60T in a thickness direction of the IC chip 350, the turning of the connector housing 60 and the connector shutter 61 halts. When the posture of the toner container 30 is changed from the first posture to the second posture with the toner container 30 mounted to the developing device 20, the connector shutter 61 moves down around the shutter shaft portions 61S to permit the contact of the ground terminal 623 and the input/output terminals 624 in the connector portion 6 with the ground terminal 351 and the input/output terminals 352 in the storage unit 35.

Thus, during the posture change of the toner container 30 from the first posture to the second posture, the second coil 641 of the housing urging spring 64 is compressed and deformed. This adjusts a contact pressure of the ground terminal 623 and the input/output terminals 624 in the connector portion 6 on the ground terminal 351 and the input/output terminals 352 in the storage unit 35. In a state where the toner container 30 is mounted to the developing device 20 in the second posture, as illustrated in FIG. 26A, the housing lock claw 604 separates downward from the locked portion 155A. This prevents the respective terminals of the connector portion 6 and the storage unit 35 from contacting one another with excessive forces, especially prevents the terminals on the IC chip 350 side from being damaged.

When the toner container 30 is held in the second posture such that the IC chip 350 in the storage unit 35 is located opposed to the connector portion 6, the connector shutter 61 abuts on the connector housing 60 and the IC chip 350, and is sandwiched between the connector housing 60 and the IC chip 350. This regulates a final contact pressure of the ground terminal 623 and the input/output terminals 624 in the connector portion 6 on the ground terminal 351 and the input/output terminals 352 in the storage unit 35. That is, the connector shutter 61 functions as a spacer to determine the positions of the IC chip 350 and the terminal unit 62. This stably maintains the contact pressure between the terminals of the connector portion 6 and the storage unit 35.

As described above, in this embodiment, the ground terminal 351 and the input/output terminals 352 in the storage unit 35 are terminals having outermost surfaces on which gold plating layers are formed. The terminals with the gold plating layers are terminals hard to be oxidized and having high conductive property holdable over a long period of time. On the other hand, the terminals with the gold plating layers have a drawback where the gold plating layers are easily peeled due to abrasion. When the gold plating layers are peeled, substrate metal plates containing, for example, Nickel easy to be oxidized are exposed, thus causing the conduction failure between the terminals of the connector portion 6 and the storage unit 35.

As described above, in this embodiment, in a state where the toner container 30 is mounted to the developing device 20 in the first posture, the ground terminal 351 and the input/output terminals 352 in the storage unit 35 are located to be separated from the ground terminal 623 and the input/output terminals 624 in the connector portion 6, thus preventing the abrasion of the ground terminal 351 and the input/output terminals 352 in the storage unit 35 caused by the vibration during the transportation and similar factor. Accordingly, even when the ground terminal 351 and the input/output terminals 352 in the storage unit 35 are terminals on which gold plating layers are formed, this prevents the gold plating layers from being peeled due to, for example, the vibration during the transportation. Then, the high conductive property of the gold plating layer is ensured.

Second Embodiment

Figure 27:
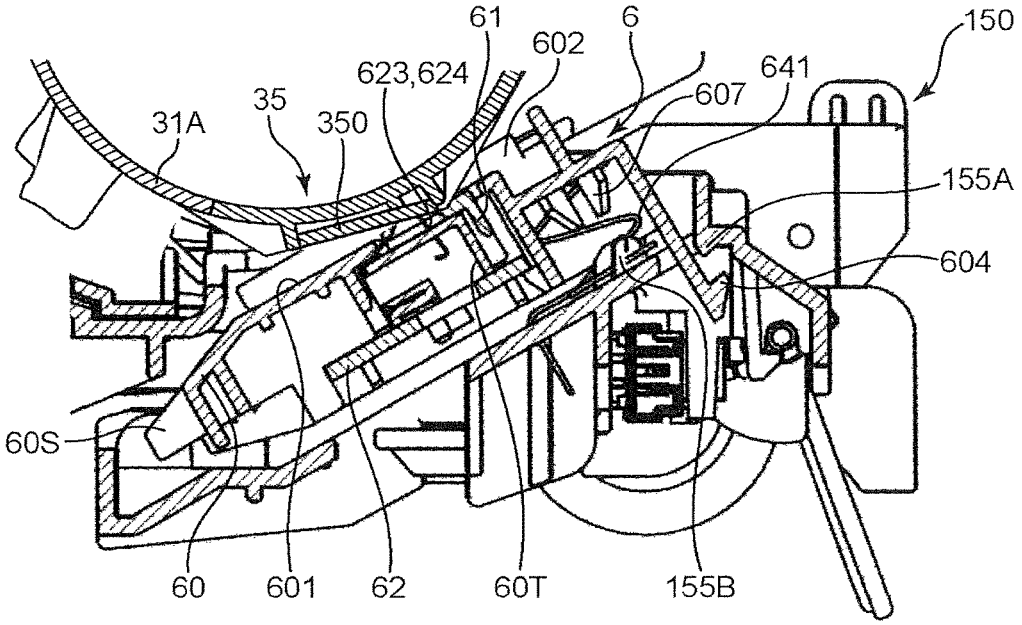
FIG. 27 illustrates a cross-sectional view of a positional relation between the storage unit and the connector portion in a state where the toner container is mounted to the developing device in the first posture in the image forming apparatus according to a second embodiment.
Figure 28:
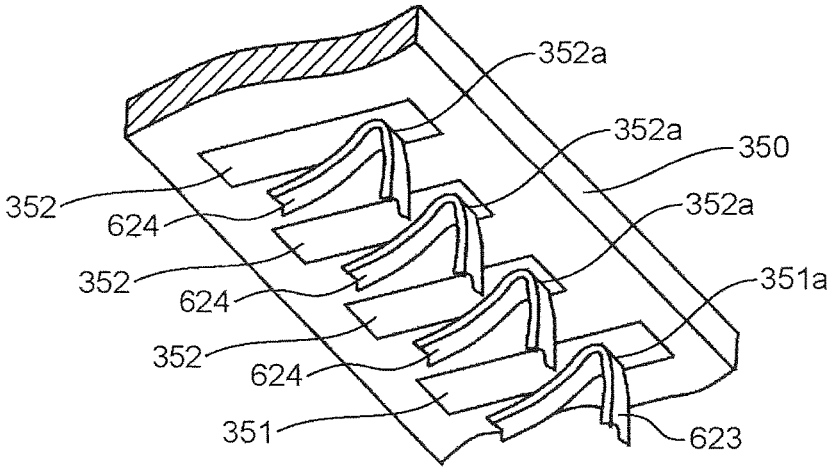
FIG. 28 illustrates a perspective view of a contact state between respective terminals of the storage unit and the connector portion in a state where the toner container is mounted to the developing device in the first posture.
Figure 29:
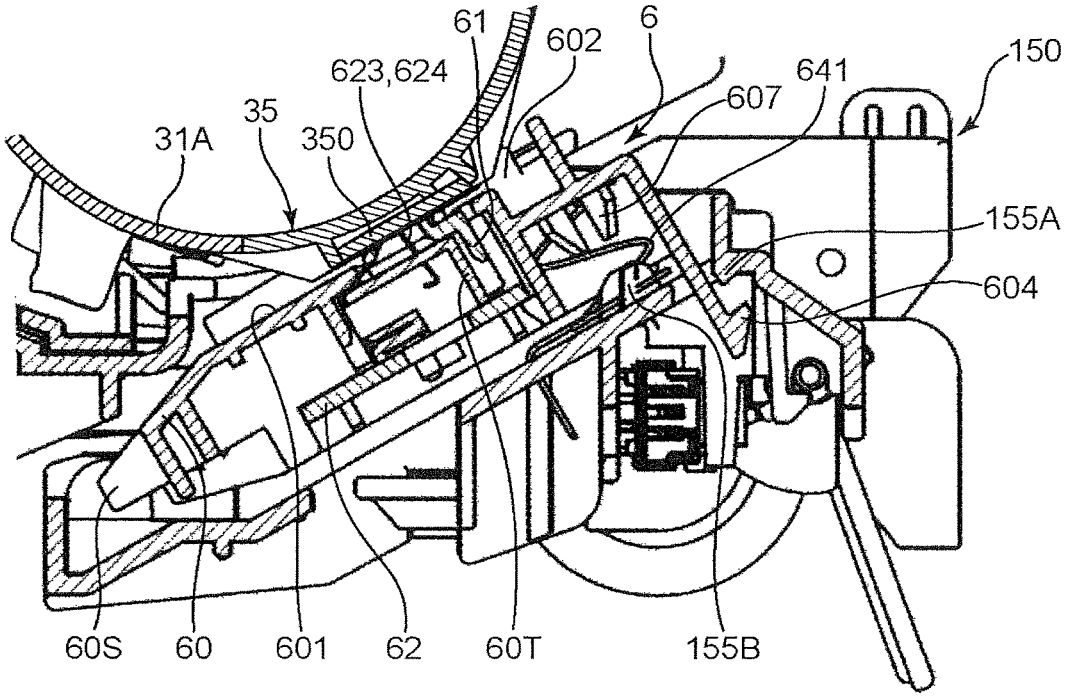
FIG. 29 illustrates a cross-sectional view of a positional relation between the storage unit and the connector portion in a state where the toner container is mounted to the developing device in the second posture in the image forming apparatus according to the second embodiment.
Figure 30:
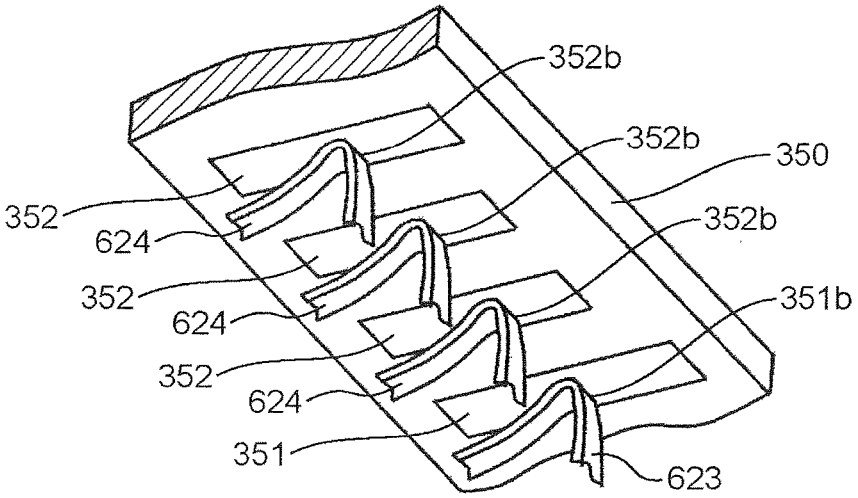
FIG. 30 illustrates a perspective view of a contact state between respective terminals of the storage unit and the connector portion in a state where the toner container is mounted to the developing device in the second posture.

FIG. 27 illustrates a cross-sectional view of a positional relation between a storage unit 35 and a connector portion 6 in a state where a toner container 30 is mounted to a developing device 20 in a first posture in an image forming apparatus 100 according to a second embodiment. FIG. 28 illustrates a perspective view of a contact state between respective terminals of the storage unit 35 and the connector portion 6 in a state where the toner container 30 is mounted to the developing device 20 in the first posture. FIG. 29 illustrates a cross-sectional view of a positional relation between the storage unit 35 and the connector portion 6 in a state where the toner container 30 is mounted to the developing device 20 in a second posture in the image forming apparatus 100 according to the second embodiment. FIG. 30 illustrates a perspective view of the contact state between the respective terminals of the storage unit 35 and the connector portion 6 in a state where the toner container 30 is mounted to the developing device 20 in the second posture.

In the image forming apparatus 100 according to the second embodiment, as described above, in a state where the toner container 30 is mounted to a container mounting portion 20H of the developing device 20, the posture of the toner container 30 is changeable between the first posture where a toner discharge port 30P does not communicate with a toner replenishment port 204 of the developing device 20 and the second posture where the toner discharge port 30P communicates with the toner replenishment port 204.

Here, focusing on the positional relation between the storage unit 35 mounted on an outer surface of a main unit 31A of the toner container 30 and the connector portion 6 located on a main body unit 150 constituting a part of a housing 101, in a state where the toner container 30 is mounted to the developing device 20 in the first posture, as illustrated in FIGS. 27 and 28, a predetermined first region 351*a* of a ground terminal 351 of an IC chip 350 in the storage unit 35 contacts a ground terminal 623 of the connector portion 6, and predetermined first regions 352*a* of the input/output terminals 352 of the IC chip 350 in the storage unit 35 contact the input/output terminals 624 of the connector portion 6 so as to be electrically connectable.

In a state where the toner container 30 is mounted to the developing device 20 in the first posture, the first regions 351*a* and 352*a* of each of the ground terminal 351 and the input/output terminals 352 in the storage unit 35 contact the ground terminal 623 and the input/output terminals 624 in the connector portion 6 so as to be electrically connectable. This ensures transmitting and receiving predetermined information stored in the storage unit 35 in a state where the toner container 30 is held in the first posture. Accordingly, on a time point where the toner container 30 is mounted to the developing device 20, a check whether or not the information stored in the storage unit 35 includes errors or similar check can be performed via the connector portion 6.

On the other hand, in a state where the toner container 30 is mounted to the developing device 20 in the second posture, as illustrated in FIGS. 29 and 30, a predetermined second region 351*b* of the ground terminal 351 of the IC chip 350 in the storage unit 35 contacts the ground terminal 623 of the connector portion 6, and predetermined second regions 352*b* of the input/output terminals 352 of the IC chip 350 in the storage unit 35 contact the input/output terminals 624 of the connector portion 6 so as to be electrically connectable. Here, in the storage unit 35, the second region 351*b* of the ground terminal 351 is a region different from the first region 351*a* in a longitudinal direction where the ground terminal 351 extends, and the second regions 352*b* of the input/output terminals 352 are regions different from the first regions 352*a* in a longitudinal direction where the input/output terminals 352 extend.

In transporting the image forming apparatus 100 after checking the information stored in the storage unit 35, the image forming apparatus 100 is packed in a state where the toner container 30 is mounted to the developing device 20 in the first posture. The transportation of the image forming apparatus 100 in such packing state sometimes causes abrasion of the first regions 351*a* and 352*a*, which contact the ground terminal 623 and the input/output terminals 624 in the connector portion 6, of the ground terminal 351 and the input/output terminals 352 in the storage unit 35 due to the vibration during the transportation and similar factor. Thus, even when the abrasion of the first regions 351*a* and 352*a*, which contact the ground terminal 623 and the input/output terminals 624 in the connector portion 6, of the ground terminal 351 and the input/output terminals 352 in the storage unit 35 due to the vibration during the transportation and similar factor occurs during the transportation of the image forming apparatus 100, the posture change of the toner container 30 from the first posture to the second posture after the installation of the image forming apparatus 100 causes the second regions 351*b* and 352*b*, which are different from the first regions 351*a* and 352*a* of the ground terminal 351 and the input/output terminals 352 in the storage unit 35 to contact the ground terminal 623 and the input/output terminals 624 in the connector portion 6, thus ensuring the electrical connection. This ensures the stability of the contact communication of the storage unit 35 without the conduction failures between the storage unit 35 and the connector portion 6 in a state where the toner container 30 is held in the second posture.

As described above, the toner container 30 is turnable in both forward and reverse directions around the axis center of the container paddle 30K in a state where the toner container 30 is mounted to the container mounting portion 20H of the developing device 20. Turning the toner container 30 in the forward direction DM from the first posture changes the posture to the second posture. Turning the toner container 30 in the reverse direction DN from the second posture changes the posture to the first posture.

The following describes the turning operation during the posture change of the toner container 30 more specifically.

When the toner container 30 is not mounted to the container mounting portion 20H of the developing device 20, similarly to the above-described first embodiment, the connector housing 60 of the connector portion 6 is urged upward around the housing shaft portions 60S by the second coil 641. The connector shutter 61 of the connector portion 6 is urged upward around the shutter shaft portions 61S by an urging force from the first coil 631. In the connector portion 6, the ground terminal 623 and the input/output terminals 624 projecting from the housing opening 60H of the connector housing 60 are sunk inside the first opening 613 and the second openings 614 of the connector shutter 61, respectively. Then, in the connector portion 6, the ground terminal 623 and the input/output terminals 624 are protected by the connector shutter 61.

When the toner container 30 is mounted to the container mounting portion 20H of the developing device 20 to have the first posture, as illustrated in FIG. 27, a part of each guide piece 35D (see FIG. 15) of the storage unit 35 abuts on the support surface 601 of the connector portion 6 (see FIGS. 19A and 27) while a part of the IC chip 350 of the storage unit 35 abuts on the connector shutter 61. Then, as illustrated in FIG. 27, the connector housing 60 moves down around the housing shaft portions 60S against the urging force of the second coil 641 while the connector shutter 61 moves down around the shutter shaft portions 61S against the urging force of the first coil 631. When the connector housing 60 moves down around the housing shaft portions 60S, the housing lock claw 604 separates downward from the locked portion 155A. When the connector shutter 61 moves down around the shutter shaft portion 61S, as described above, the first regions 351*a* and 352*a* of the ground terminal 351 and the input/output terminals 352 in the storage unit 35 contact the ground terminal 623 and the input/output terminals 624 of the connector portion 6.

On the other hand, when the toner container 30 mounted to the developing device 20 is turned in the forward direction DM for changing the posture from the first posture to the second posture, while the guide pieces 35D in the storage unit 35 are guided by the inclined surface 601T (see FIG. 19A) and the first guide portions 602A (see FIG. 19A) in the connector portion 6, the guide pieces 35D press the support surface 601 (see FIGS. 19A and 29), thus the connector housing 60 moves down around the housing shaft portions 60S against the urging force from the second coil 641.

The IC chip 350 in the storage unit 35 presses the connector shutter 61 downward while abutting on the connector shutter 61 along the support surface 601 in the connector portion 6. This moves down the connector shutter 61 around the shutter shaft portions 61S against the urging force from the first coil 631. Then, as illustrated in FIG. 29, when the toner container 30 comes in the second posture such that the IC chip 350 in the storage unit 35 is located opposed to the support surface 601 in the connector portion 6 and the connector shutter 61 is sandwiched between the IC chip 350 and the support wall 60T in a thickness direction of the IC chip 350, the turning of the connector housing 60 and the connector shutter 61 halts. When the posture of the toner container 30 is changed from the first posture to the second posture with the toner container 30 mounted to the developing device 20, the connector shutter 61 moves down around the shutter shaft portions 61S to cause the second regions 351*b* and 352*b* of the ground terminal 351 and the input/output terminals 352 in the storage unit 35 to contact the ground terminal 623 and the input/output terminals 624 in the connector portion 6.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body including an image carrier and a developing device, the image carrier having a circumference surface that carries a developer image, the developing device supplying a developer onto the circumference surface of the image carrier;

a connector portion located on the apparatus main body, the connector portion including a first input/output terminal; and a developer housing container removably mounted to the developing device, the developer housing container including:

a container body that houses the developer to be replenished to the developing device; and a storage unit mounted to an outer surface of the container body, the storage unit including a second input/output terminal for electrical connection to the first input/output terminal, the storage unit storing predetermined information, wherein in a state where the developer housing container is mounted to the developing device, the developer housing container has a posture changeable between:

a first posture where the second input/output terminal is separated from the first input/output terminal, and a second posture where the second input/output terminal contacts the first input/output terminal to be electrically connected, wherein the developer housing container is turnable around a predetermined axis in both forward and reverse directions in a state of being mounted to the developing device, and turning the developer housing container in the forward direction from the first posture changes the posture to the second posture and turning the developer housing container in the reverse direction from the second posture changes the posture to the first posture, and the second input/output terminal has a predetermined length in the turning direction of the developer housing container.

2. The image forming apparatus according to claim 1 wherein the connector portion includes a regulating member that permits the first input/output terminal to contact the second input/output terminal when the developer housing container is in the second posture, and restrict the first input/output terminal from contacting the container body when the developer housing container is in the first posture.

3. An image forming apparatus comprising:

an apparatus main body including an image carrier and a developing device, the image carrier having a circumference surface that carries a developer image, the developing device supplying a developer onto the circumference surface of the image carrier;

a connector portion located on the apparatus main body, the connector portion including a first input/output terminal; and a developer housing container removably mounted to the developing device, the developer housing container including:

a container body that houses the developer to be replenished to the developing device; and a storage unit mounted to an outer surface of the container body, the storage unit including a second input/output terminal for electrical connection to the first input/output terminal, the storage unit storing predetermined information, wherein in a state where the developer housing container is mounted to the developing device, the developer housing container has a posture changeable between:

a first posture where a predetermined first region of the second input/output terminal contacts the first input/output terminal to be electrically connected, and a second posture where a second region different from the first region of the second input/output terminal contacts the first input/output terminal to be electrically connected.

* * * * *